US007086915B2

(12) United States Patent
Hikosaka et al.

(10) Patent No.: US 7,086,915 B2
(45) Date of Patent: Aug. 8, 2006

(54) LUBRICATING STRUCTURE FOR OUTBOARD MOTORS

(75) Inventors: Tomokazu Hikosaka, Hamamatsu (JP); Katsuhiro Fukuda, Hamamatsu (JP); Yasushi Miyashita, Hamamatsu (JP); Hiroaki Koike, Hamamatsu (JP); Hideo Koyama, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 10/764,652

(22) Filed: Jan. 26, 2004

(65) Prior Publication Data

US 2004/0157511 A1 Aug. 12, 2004

(30) Foreign Application Priority Data

Jan. 31, 2003 (JP) ..... 2003-024994
Jan. 31, 2003 (JP) ..... 2003-024995

(51) Int. Cl.
*B63H 21/38* (2006.01)

(52) U.S. Cl. ..... 440/88 L; 440/88 C

(58) Field of Classification Search ..... 440/88 L
See application file for complete search history.

(56) References Cited

U.S. PATENT DOCUMENTS 5,778,848 A * 7/1998 Takahashi et al. ..... 123/196 W
6,513,463 B1 * 2/2003 Katayama ..... 123/41.29
6,868,819 B1 * 3/2005 Saiga et al. ..... 123/196 W

FOREIGN PATENT DOCUMENTS

JP 5-306633 A 11/1993
JP 10-18827 A 1/1998
JP 2001-342812 A 12/2001

* cited by examiner

*Primary Examiner*—Jesus D. Sotelo
(74) *Attorney, Agent, or Firm*—Frishauf, Holtz, Goodman & Chick, P.C.

(57) ABSTRACT

There is provided a lubricating structure for an outboard motor, which can secure a sufficiently large cross-sectional area for a main oil gallery while preventing an increase in the width of an engine thereof. A water-cooled four-cycle six-cylinder V-type engine having a generally vertically disposed crankshaft is mounted on an engine holder. A cylinder block is disposed at the rear of a crankcase disposed in the foremost end (i.e. on the bow side) of the engine, and a main oil gallery extends vertically in the starboard-side side part of the cylinder block. Namely, the main oil gallery is disposed not in a central part of the cylinder block in the transverse direction thereof, but at a location outward of cylinder bores of the cylinder block.

8 Claims, 19 Drawing Sheets

LUBRICATING STRUCTURE FOR OUTBOARD MOTORS

BACKGROUND OF THE INVENTION

1. Field of the Invention

The present invention relates to a lubricating structure for outboard motors in which oil is supplied under pressure from an oil pump to related parts of a vertically installed engine.

2. Description of the Related Art

Conventionally, a V-type engine is known which has a pair of opposed cylinder blocks disposed in a V-shaped arrangement to form a so-called V-bank for compactness of the engine. In particular, an outboard motor is demanded to be light in weight and compact in size, so that an increasing number of V-type engines are applied to outboard motors. What is more, many V-type engines for outboard motors are vertically disposed with their crankshafts extending vertically.

In general, the engine of an outboard motor is constructed such that various parts inside the engine are lubricated by oil pumped up with an oil pump. To this end, the engine is formed therein with a main oil gallery through which lubricating oil passes. The main oil gallery vertically extends along the crankshaft of the engine between the two banks of a V-bank (i.e. in a central part of the engine in the transverse direction thereof), as disclosed e.g. in Japanese Laid-Open Patent Publication (Kokai) No. H05-306633 (first prior-art lubricating structure for an outboard motor) or in Japanese Laid-Open Patent Publication (Kokai) No. H10-18827 (second prior-art lubricating structure for an outboard motor).

Particularly, an outboard motor has the maximum allowable width thereof limited depending on the width of a hull on which the outboard motor is installed. Particularly when two outboard motors are installed on a hull, for example, it is necessary to reduce the width of each outboard motor. For this reason, it has been considered advantageous for a vertically installed V-type engine of an outboard motor to have a reduced bank angle, and its design has been studied from this viewpoint.

However, when an engine is designed such that the bank angle of a V-bank is reduced (e.g. to 55 degrees or so) for reduction of the width of the engine, and a main oil gallery is formed in the central portion of the V-bank, an area where the main oil gallery can be formed is limited so as to avoid interference with a honing relief portion of a sleeve bore, for example. In addition, it is necessary to secure a sufficiently large inner diameter of oil passages for sufficient supply of lubricating oil from the main oil gallery to crank journals, which makes it difficult to form a main oil gallery having a sufficiently large cross-sectional area.

There has been also proposed a V-type engine having pistons thereof cooled by an oil jet. However, when oil passages for cooling the pistons are provided in such a conventional manner that they are in direct communication with the main oil gallery, a drop in oil pressure in the piston oil jet directly affects the main oil gallery to cause instability of oil pressure and the amount of oil to be supplied to a main journal.

In general, an outboard motor with a vertically installed engine, which is not limited to a V-type engine, has a lubricating structure in which oil stored in an oil pan disposed below the engine is pumped up with an oil pump, filtered by an oil filter, supplied under pressure to a main oil gallery, and then supplied as lubricating oil to related parts of the engine, such as crank journals, connecting rods, cylinders, and cylinder heads, through various oil passages formed within a cylinder block. An oil passage (supply passage) extending from the oil pump to the oil filter and oil passages (return passages) from the oil filter to the component parts of the engine are generally formed by machining, e.g. drilling the cylinder block such that cast through holes, which are linearly formed in the cylinder block, using a mold, communicate with each other.

On the other hand, an outboard motor has been known, which employs valve actuators for switching timing for opening and closing intake and exhaust valves between a high-speed mode and a low-speed mode. In the outboard motor, for example, oil pressure to be supplied to a variable valve timing mechanism provided at one end of a camshaft is switched by an oil control valve to thereby change the timing for opening and closing the intake and exhaust valves.

However, if oil returned through an oil filter is used both for driving the variable valve timing mechanism and lubricating cylinder heads, pressure variation in oil for lubricating the cylinder heads affects oil for driving the variable valve timing mechanism, which makes the operation of the variable valve timing mechanism unstable. To solve this problem, an engine for an outboard motor disclosed e.g. in Japanese Laid-Open Patent Publication (Kokai) No. 2001-342812 (third prior-art lubricating structure for an outboard motor) is equipped with a dedicated oil pump for driving a variable valve timing mechanism, in addition to an oil pump for lubrication, whereby the pressure of oil supplied to the variable valve timing mechanism is stabilized.

However, in the case of forming a supply passage to an oil filter and a return passage from the same in a cylinder block as in the above conventional lubricating structure for a general outboard motor, it is necessary to dispose the two passages such that they cannot interfere with cylinders, water jackets, chain transmission mechanisms, and so forth, and therefore the degree of freedom in laying out oil passages is strictly limited. Therefore, the cylinder block is apt to have an increased thickness, which hinders effective utilization of space. This is against the demand for compactness of outboard motors. That is, the outboard motor is desired to be compact in both height and width for the purpose of avoiding interference between a portion thereof located inside a hull and the hull itself when tilted up and maintaining excellent steerability, and due to limitation of the width thereof when two outboard motors are used for operation, it is significant to enhance the degree of freedom in laying out oil passages, for effective utilization of space.

Further, when two cast through holes are communicated with each other by machining, the oil passage formed thereby has a portion curved substantially at right angles, which increases fluid resistance, and makes contamination likely to occur owing to machining burrs. Furthermore, communication of the oil passage with defective cast portions (e.g. porosities within the passage) can cause oil leakage and lowering of oil pressure, thereby hindering smooth flow of oil.

On the other hand, also in the case where oil from the oil filter is used both for driving the variable valve timing mechanism and lubricating the cylinder heads, when the above third prior-art lubricating structure for an outboard motor is employed, it is necessary to additionally provide an oil pump, which complicates the construction of the outboard motor and increases manufacturing costs.

SUMMARY OF THE INVENTION

It is a first object of the present invention to provide a lubricating structure for an outboard motor, which can secure a sufficiently large cross-sectional area for a main oil gallery while preventing an increase in the width of an engine thereof.

It is a second object of the present invention to provide a lubricating structure for an outboard motor, which is capable of reducing influence of an oil gallery upon a main oil gallery.

It is a third object of the present invention to provide a lubricating structure for an outboard motor, which enhances the degree of freedom in laying out oil passages, thereby enabling effective utilization of space, and is capable of reducing the number of oil passages formed by machining, thereby achieving smooth oil feed.

It is a fourth object of the present invention to provide a lubricating structure for an outboard motor, which is capable of reducing influence of pressure variation in oil passages for lubricating cylinder heads upon oil passages for driving a variable valve timing mechanism, thereby stabilizing the operation of the variable valve timing mechanism.

To attain the above first object, in a first aspect of the present invention, there is provided a lubricating structure for an outboard motor, comprising a vertically installed V-type engine having a side part, and a main oil gallery formed in the side part of the engine, for allowing lubricating oil to pass therethrough.

Preferably, the lubricating structure comprises an oil filter disposed in the side part of the engine at a location close to the main oil gallery in a fashion directly connected thereto, for filtering the lubricating oil.

To attain the above second object, in a second aspect of the present invention, there is provided a lubricating structure for an outboard motor, comprising a vertically installed V-type engine, a main oil gallery formed in the engine, and an oil gallery formed substantially in a central part of the engine in a transverse direction of the engine, as a passage separate from the main oil gallery, for allowing oil for cooling pistons to pass therethrough.

Preferably, the lubricating structure comprises a coolant passage formed in the engine at a location close to the oil gallery, for cooling the oil gallery.

To attain the above third object, in a third aspect of the present invention, there is provided a lubricating structure for an outboard motor, comprising a vertically installed V-type engine including a cylinder block having a bottom part and an oil filter, an oil passage formed in the bottom part of the cylinder block, and a supply passage extending to the oil filter and a return passage extending from the oil filter, the supply passage and the return passage being formed by partitioning the oil passage.

Preferably, the lubricating structure comprises a lid assembly, and at least one of the supply passage and the return passage has a part thereof formed by casting and covered by the lid assembly to form a passage.

Preferably, the lubricating structure comprises a lid assembly, and one of the supply passage and the return passage has a part thereof formed by casting and covered by the lid assembly to form a passage, and the other of the supply passage and the return passage is formed in the lid assembly.

Preferably, the lubricating structure comprises a plurality of distribution passages in communication with the return passage, for distributing oil to component parts of the engine.

To attain the above fourth object, in a fourth aspect of the present invention, there is provided a lubricating structure for an outboard motor, comprising a cylinder block, a cylinder head having an oil passage formed therein, a hydraulically driven variable valve timing mechanism, an oil pump for supplying oil under pressure, the oil supplied under pressure from the oil pump being supplied as driving oil to the variable valve timing mechanism from the cylinder block through the oil passage formed in the cylinder head, and supplied as lubricating oil to the cylinder head, and at least one first passage and at least one second passage formed as passages separate from each other in the cylinder block, for guiding the oil supplied under pressure from the oil pump to the cylinder head, wherein the cylinder block has at least one head-lubricating oil hole formed therein, for supplying the oil supplied through the first passage formed in the cylinder block to component parts within the cylinder head, as lubricating oil, and wherein the cylinder block has at least one mechanism-driving oil hole formed therein, as a passage separate from the head-lubricating oil hole, for supplying the oil supplied through the second passage formed in the cylinder block to the variable valve timing mechanism, as driving oil.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the accompanying drawings showing a preferred embodiment thereof.

Figure 1:
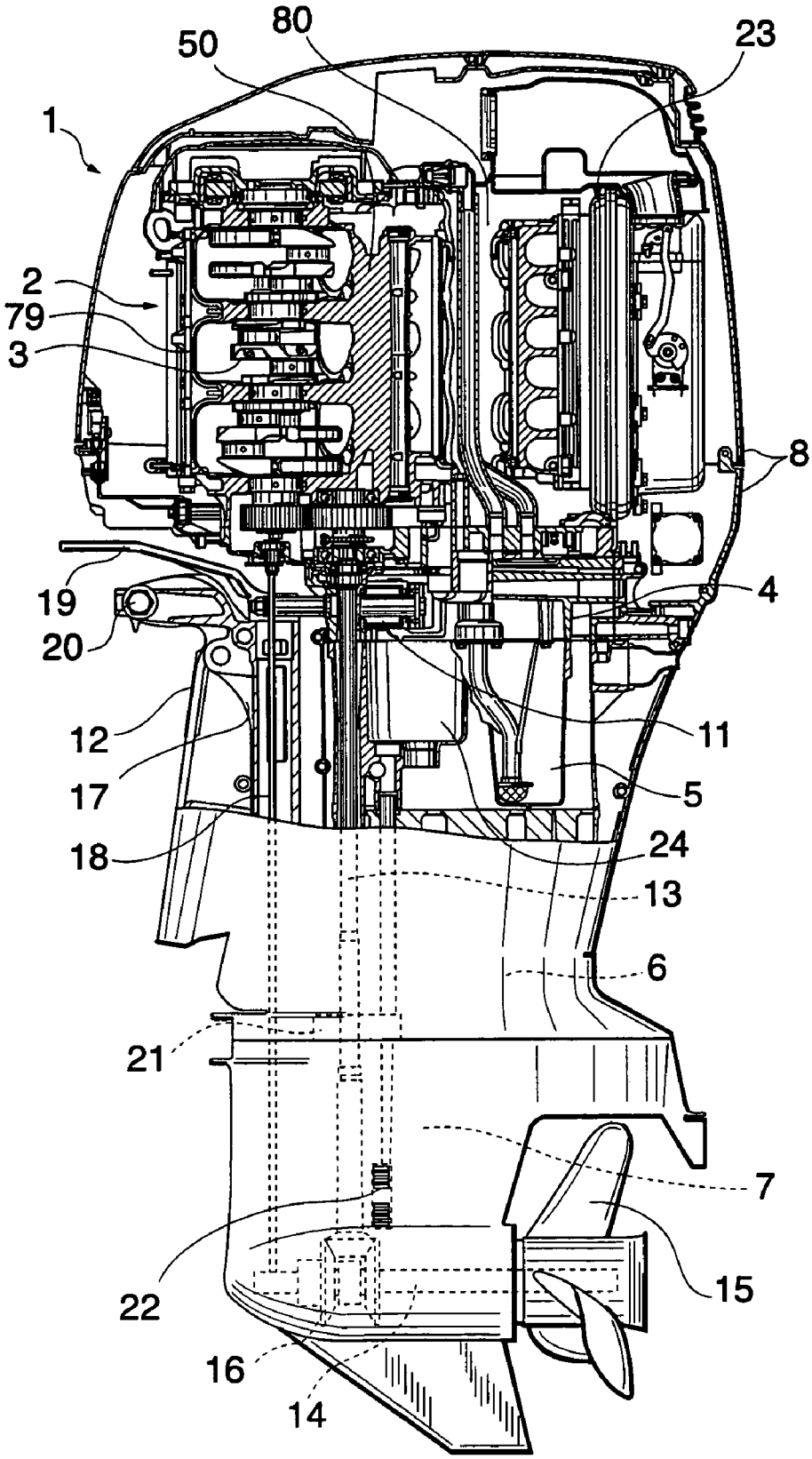
FIG. 1 is a longitudinal cross-sectional view showing the construction of an outboard motor to which is applied a lubricating structure for an outboard motor, according to an embodiment of the present invention.
Figure 2:
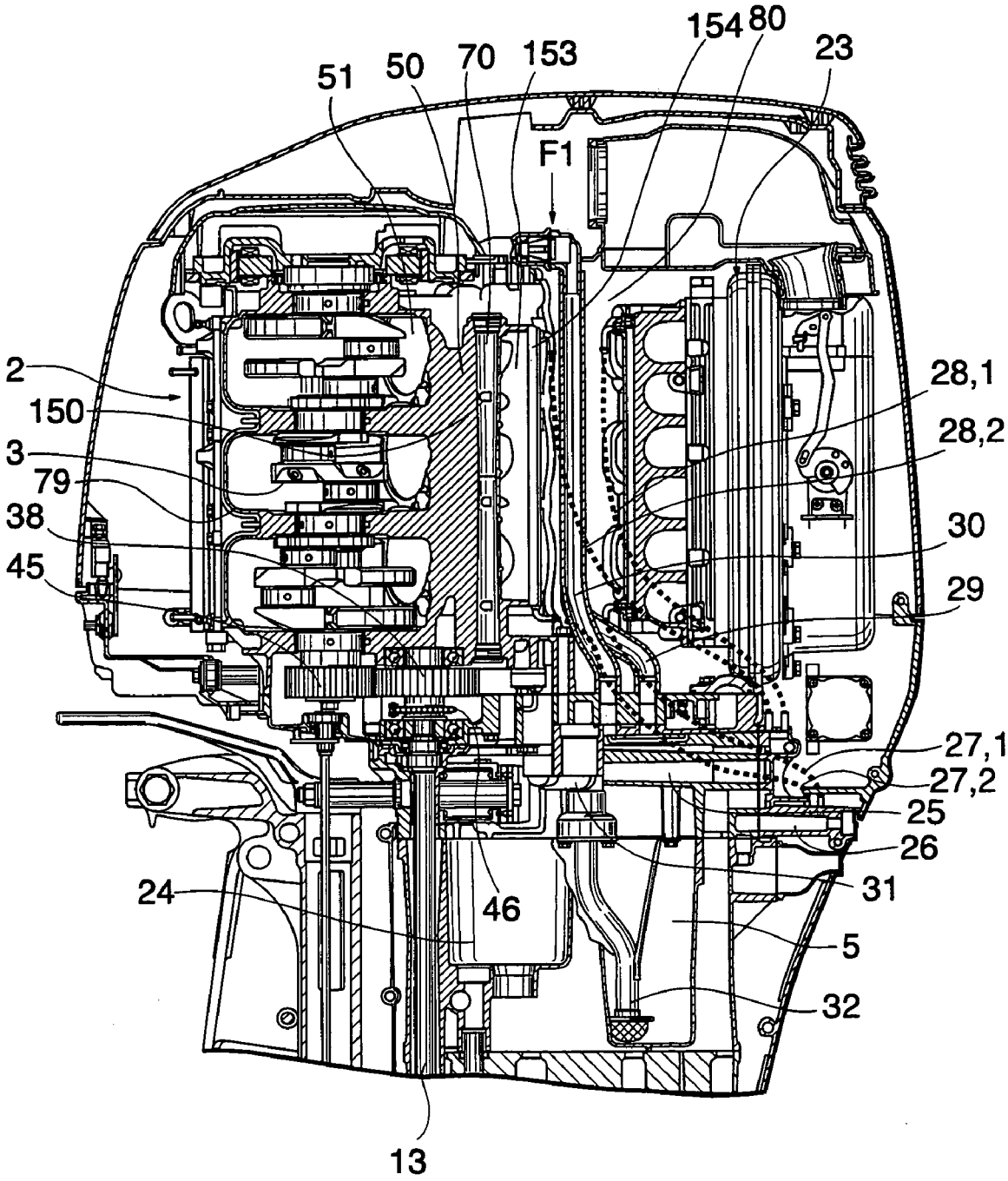
FIG. 2 is a cross-sectional view of an upper half of the outboard motor.

FIG. 1 is a longitudinal cross-sectional view showing the construction of an outboard motor to which is applied a lubricating structure for an outboard motor, according to an embodiment of the present invention. Hereafter, the left side, as viewed in FIG. 1, of the outboard motor 1 according the present embodiment will be referred to as "the front", the right side thereof as "the rear", and the upper side as "the top". Further, the side toward the viewer, as viewed in FIG. 1, will be referred to as "the port side", and the side remote from the viewer as "the starboard side". FIG. 2 is a cross-sectional view of the upper half of the outboard motor 1.

As shown in FIG. 1, the outboard motor 1 includes an engine holder 4 on which an engine (V-type engine) 2 is mounted. The engine 2 is a water-cooled four-cycle six-cylinder V-type engine having a crankshaft 3 substantially perpendicularly (vertically) extending therein.

An oil pan 5 is joined and fixed to a lower surface of the engine holder 4, and a drive shaft housing 6 and a gear housing 7 are arranged below the oil pan 5 in the mentioned order. The engine 2, the engine holder 4, and the oil pan 5 are covered by a vertically dividable engine cover 8.

The drive shaft housing 6 is fixed to the lower end of the oil pan 5. A drive shaft 13 substantially vertically extends through the engine holder 4, the oil pan 5, and the drive shaft housing 6. The drive shaft 13 further extends downward from the drive shaft housing 6 to drive a propeller 15 as a propulsion device via a bevel gear 16 and a propeller shaft 14 within the gear housing 7 fixed to the lower end of the drive shaft housing 6.

A pair of left and right upper mounts 11 are arranged near the front edge of the engine holder 4. The upper mounts 11 are connected to an upper mount bracket 19. On the other hand, a pair of lower mounts, not shown, are arranged on opposite sides of the drive shaft housing 6. The front ends of the upper mounts 11 and those of the lower mounts are connected to a clamp bracket 12, and the clamp bracket 12 is fixed to a stern plate, not shown, of a hull, not shown.

The clamp bracket 12 has a swivel bracket 17 attached thereto via a tilt shaft 20, and a pilot shaft 18 is rotatably supported in the swivel bracket 17 in a vertical direction. The pilot shaft 18 has the upper mount bracket 19 and the lower mount bracket, not shown, rotatably attached to upper and lower ends thereof, respectively. With this arrangement, the outboard motor 1 can be steered about the pilot shaft 18 from side to side with respect to the clamp bracket 12 and tilted upward about the tilt shaft 20.

A cylinder block 50 is disposed at the rear of a crankcase 79 disposed in the foremost end (i.e. on the bow side) of the engine 2, and a cylinder head 80 and an intake device 23 are arranged at the rear of the cylinder block 50 in the mentioned order. The crankshaft 3 is journaled between joined surfaces of the crankcase 79 and the cylinder block 50.

The drive shaft 13 is disposed such that the axis thereof is offset rearward (toward the cylinder head 80) from that of the crankshaft 3. As shown in FIG. 2, a reduction drive gear 45 is fitted on the lower end of the crankshaft 3, while a reduction driven gear 38 in mesh with the reduction drive gear 45 is coaxially fitted on the upper end of the drive shaft 13. As the crankshaft 3 rotates, torque thereof is transmitted to the reduction driven gear 38 via the reduction drive gear 45, whereby the drive shaft 13 is driven for rotation at a reduced speed compared with rotation of the crankshaft 3.

As shown in FIG. 1, on the top of the gear housing 7, there is disposed a water pump 21 which is driven by the drive shaft 13. The water pump 21 has a water inlet 22 thereof open into the gear housing 7. Further, a water reservoir 24 is formed below the engine holder 4 into which flows outside water (sea water, lake water, river water, etc.) taken in as coolant by the water pump 21 via the water inlet 22.

As shown in FIG. 2, the engine holder 4 is formed therein with an up passage 25 through which water flows up from the water reservoir 24. The coolant having passed through the up passage 25 is delivered to pipes 27(1) and 27(2) via a union 26. The pipe 27(1) supplies the coolant to the intake device 23. The pipe 27(2) supplies the coolant to a piston-cooling gallery cooling passage (coolant passage) 153 formed in the cylinder block 50, to thereby cool oil within a piston-cooling gallery (oil gallery) 70 (which will be described in detail hereinafter).

Further, the water having cooled the intake device 23 and the water having passed through the piston-cooling gallery cooling passage 153 flow through respective pipes 28(1) and 28(2) to return to a predetermined down passage. Some of the coolant supplied to the water reservoir 24 by the water pump 21 is divided by two coolant passages, not shown, formed in the engine holder 4, and the divided flows of the coolant cool the cylinder block 50 and the left and right cylinder heads 80, respectively, followed by returning to the predetermined down passage through respective pipes 29, 30. The flows of water having returned after performing the cooling function are discharged into water outside the outboard motor 1 from a central hole of the propeller 15 together with exhaust gases.

At the bottom of the engine 2, there is provided an oil pump 31 which is connected to an oil strainer 32 extending to an inner bottom portion of the oil pan 5. Oil stored in the oil pan 5 is pumped up by the oil pump 31 through the oil strainer 32, and then supplied to related parts within the engine 2, followed by being returned to the oil pan 5.

Figure 3:
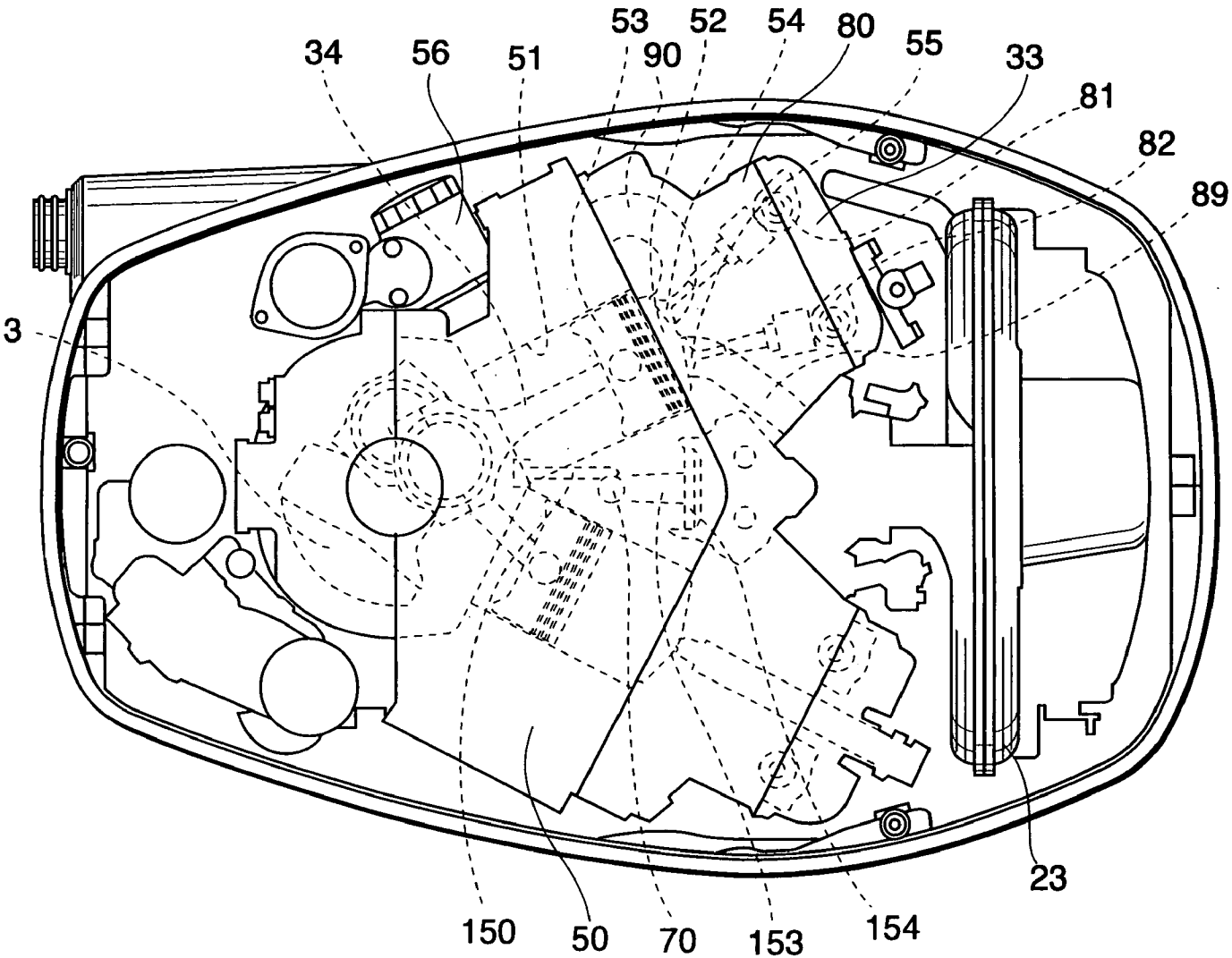
FIG. 3 is an end view, partly in cross-section, of the outboard motor, taken from an arrow F1 in FIG. 2.

FIG. 3 is a view taken from an arrow F1 in FIG. 2, partly in cross section.

The pair of left and right cylinder heads 80 are arranged such that they form a V-shaped cylinder bank open rearward as viewed in plan view. In the present embodiment, the bank angle of the V-shaped cylinder bank is set to a small value (e.g. approximately 55 degrees) with a view to reducing the width of the outboard motor 1.

The left and right cylinder banks are identical in basic structure. The cylinder block 50 has three cylinder bores 51 formed on each side (i.e. in each cylinder bank), and in each of the cylinder heads 80, there are formed a combustion chamber 52 disposed in alignment with each of the cylinder bores 51, and an intake port 89 and an exhaust port 90 communicating with the combustion chamber 52. The cylinder head 80 has a head cover 33 mounted thereon, and intake and exhaust camshafts 82 and 81 are rotatably journaled such that they extend through a cam chamber defined between the cylinder head 80 and the head cover 33.

Each intake port 89 has an inlet opening that opens in an inner surface of the V shape formed by the cylinder banks (cylinder head 80), and a communicating portion communicating with the associated combustion chamber 52, which is opened and closed by an intake valve 55 cooperatively associated with the intake camshaft 82. On the other hand, each exhaust port 90 has an outlet opening that opens in an outer surface of the V shape formed by the cylinder banks, and a communicating portion communicating with the associated combustion chamber 52, which is opened and closed by an exhaust valve 54 cooperatively associated with the exhaust camshaft 81.

The reciprocating motion of a piston 53 slidably inserted into each cylinder bore 51 is converted to rotating motion of the crankshaft 3 via a connecting rod 34, and the torque thus produced is transmitted to the reduction drive gear 45 (see FIG. 2). Exhaust gases from the exhaust port 90 are discharged into outside water through a predetermined exhaust passage.

An oil filter 56 is disposed in a lower right-side part of the cylinder block 50 (which will be described in detail hereinafter). The piston-cooling gallery 70 is formed in an approximately central part of the cylinder block 50 in the transverse direction of the same and in the inner part of the V shape formed by the cylinder banks. The piston-cooling gallery cooling passage 153 is formed by sealing a cast space close to the rear of the piston-cooling gallery 70, from behind by the lid 154. A piston jet passage 150 is in communication with the piston-cooling gallery 70. The piston-cooling gallery 70 and the piston jet passage 150 will be described in detail hereinafter with reference to FIG. 16.

Figure 4:
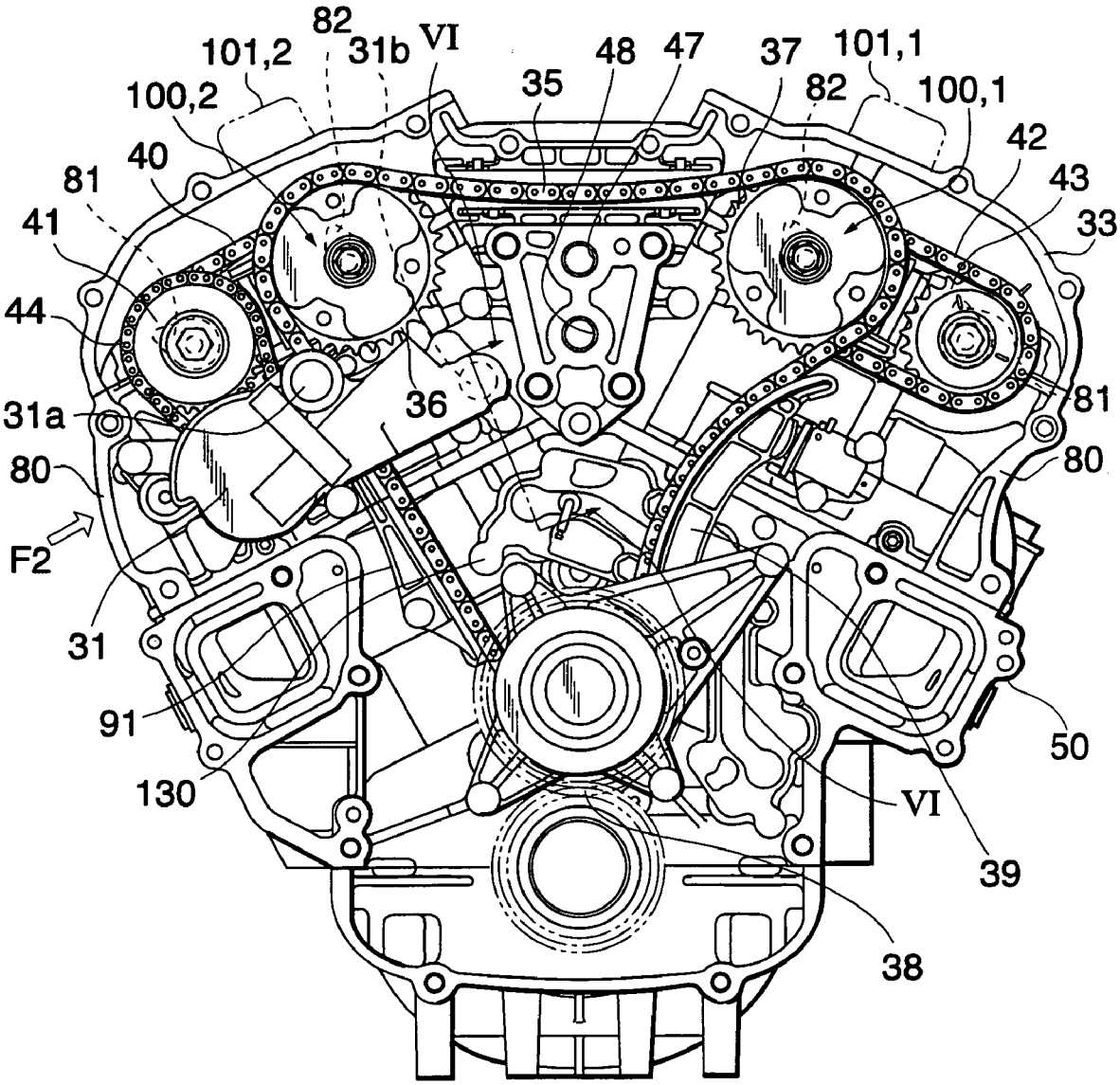
FIG. 4 is a bottom view of essential parts arranged upward of an oil pan of the outboard motor, with an engine holder removed.
Figure 5:
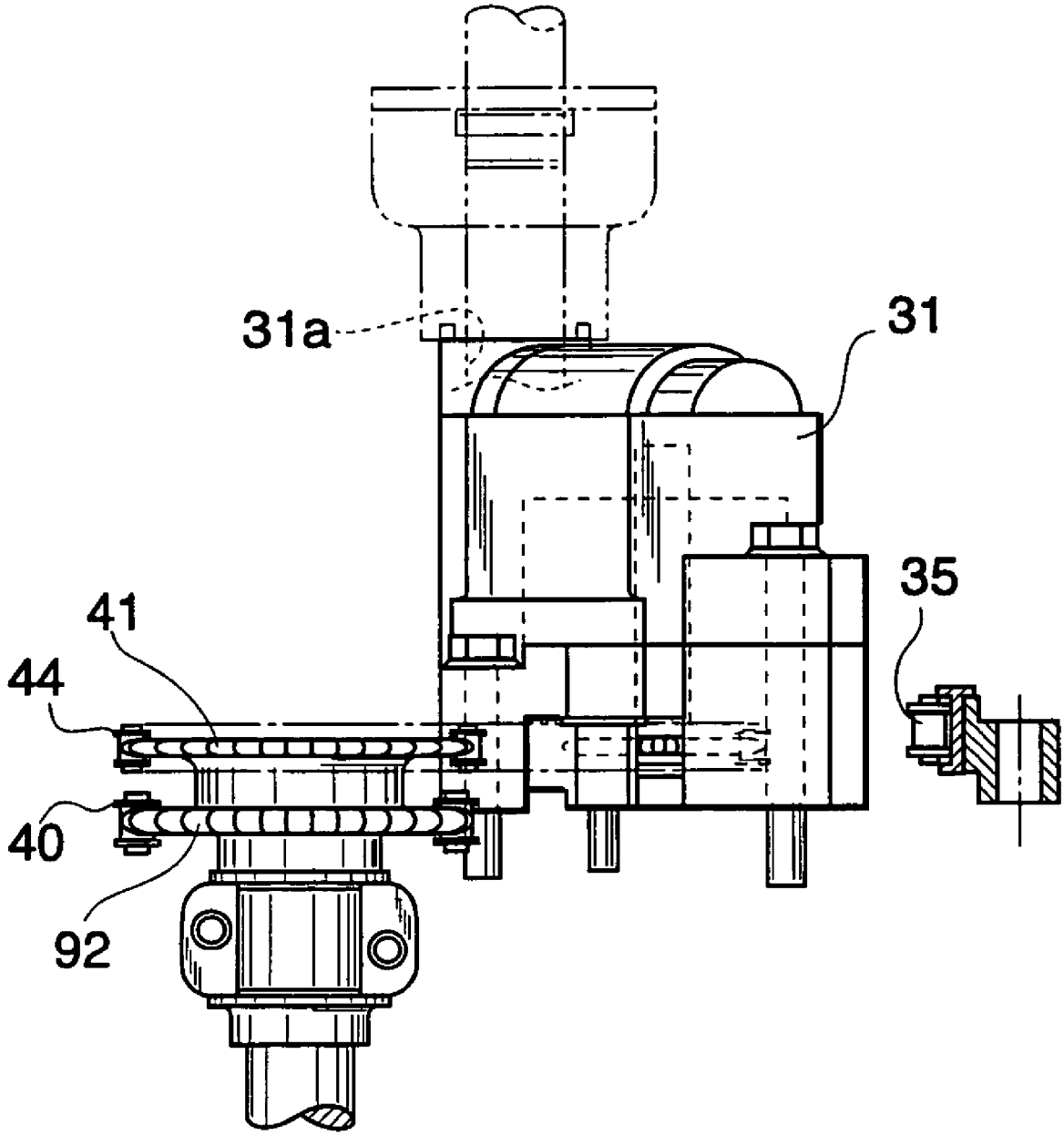
FIG. 5 is a view of an oil pump and component parts in the vicinity thereof, taken from an arrow F2 in FIG. 4.

FIG. 4 is a bottom view of essential parts, arranged upward of the oil pan 5, of the outboard motor 1, with the engine holder 4 removed. The top side of FIG. 4 corresponds to the rear side of the outboard motor 1. FIG. 5 is a view of the oil pump 31 and component parts in the vicinity thereof, taken from an arrow F2 in FIG. 4.

As shown in FIG. 4, cam sprockets 36 and 37 are fixed to the respective lower ends of the two camshafts 82. The starboard-side exhaust camshaft 81 has a cam sprocket 43 fixed to the lower end thereof. The port-side exhaust camshaft 81 has a cam sprocket 92 and a cam sprocket 41 fixed to the lower end thereof (see FIG. 5 as well). Further, although not shown in FIG. 4, a timing sprocket 46 is fixed to the reduction driven gear 38 (see FIG. 2). A timing chain 35 is passed over the cam sprockets 36 and 37 and the timing sprocket 46. A chain guide 91 disposed on the tension side (port side) of the timing chain 35 and a chain tensioner 39 disposed on the loose side of the timing chain 35 always maintain proper curvature and tension of the timing chain 35.

Further, the two intake camshafts 82 have other cam sprockets (not shown) fixed thereto, respectively. The cam sprockets 92 and 43 have cam chains 40 and 42 passed thereover, respectively, such that the intake camshaft 82 and the exhaust camshaft 81 rotate in synchronism with each other. Further, a chain 44 for the oil pump is wound around the cam sprocket 41 so as to drive the oil pump 31 by the port-side exhaust camshaft 81.

Variable valve timing devices (VVT) 100(1) and 100(2) are fixed to the cam sprockets 37 and 36 fitted on the lower ends of the two intake camshafts 82, respectively. Further, oil control valves (OCV) 101(1) and 101(2) are provided in association with the variable valve timing devices (VVT) 100(1) and 100(2), respectively. Each of the oil control valves 101 is attached to a camshaft housing, not shown, (which is formed integrally with the head covers 33).

The variable valve timing devices 100 are hydraulically driven. Oil pressure to be supplied to each variable valve timing device 100 is changed by the associated oil control valve 101, such that timing for opening and closing the associated intake valve 55 is controlled according to the engine rotational speed. A path over which the oil pressure is supplied to the variable valve timing device 100 is provided separately from a path for oil for lubricating the cylinder head 80, which will be described in detail hereinafter.

The construction of the variable valve timing device 100 and the manner of driving the oil control valve 101 are known e.g. from Japanese Laid-Open Patent Publication (Kokai) H05-306633, referred to hereinbefore, and therefore description thereof is omitted.

Holes 47 and 48 formed in a central part of the engine 2 in the transverse direction thereof are connected to the pipes 29 and 30 (see FIG. 2), respectively. Oil pumped up from the oil pan 5 through the oil strainer 32 flows into the oil pump 31 via an oil suction port 31*a* (see FIG. 5 as well), followed by being discharged from an oil discharge port 31*b* of the oil pump 31.

Figure 6:
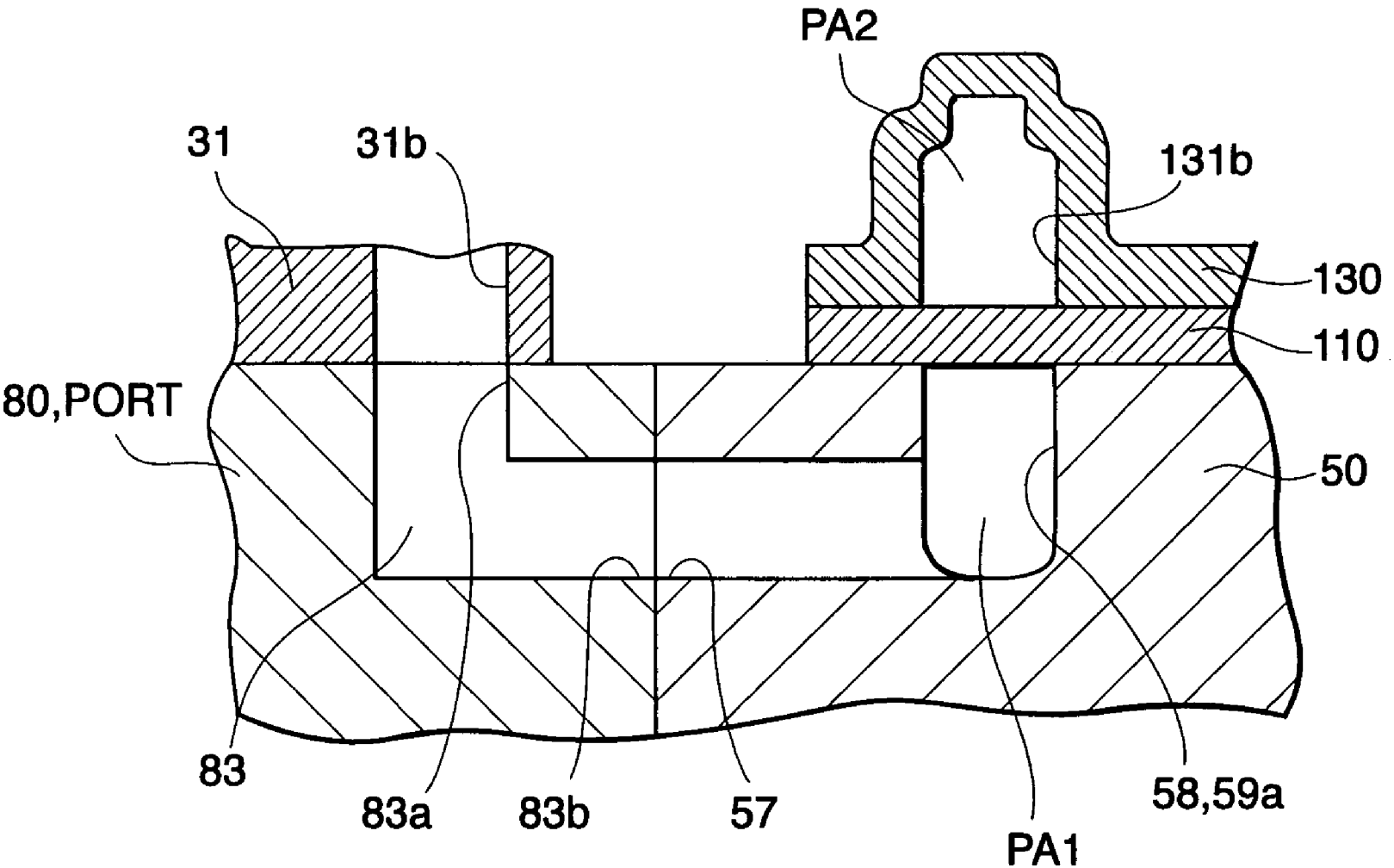
FIG. 6 is a fragmentary cross-sectional view taken on line VI—VI in FIG. 4.

FIG. 6 is a fragmentary cross-sectional view taken on line VI—VI in FIG. 4.

The port-side cylinder head 80 (PORT) is formed therein with an oil passage 83, and an inlet port 83*a* of the oil passage 83 is aligned with the oil discharge port 31*b* of the oil pump 31. The cylinder block 50 is formed therein with an oil passage 57, and a cylinder head-side opening of the oil passage 57 is aligned with an outlet port 83*b* of the oil passage 83. The oil passage 57 is continuous with an oil hole 58 leading to an oil supply passage PA1. As described in detail hereinafter, a cover 130 is attached to a bottom surface of the cylinder block 50 via a plate 110, and an oil return passage PA2 is defined by the cover 130 and the plate 110. The oil supply passage PA1 and the oil return passage PA2 will also be described in detail hereinafter.

Figure 7:
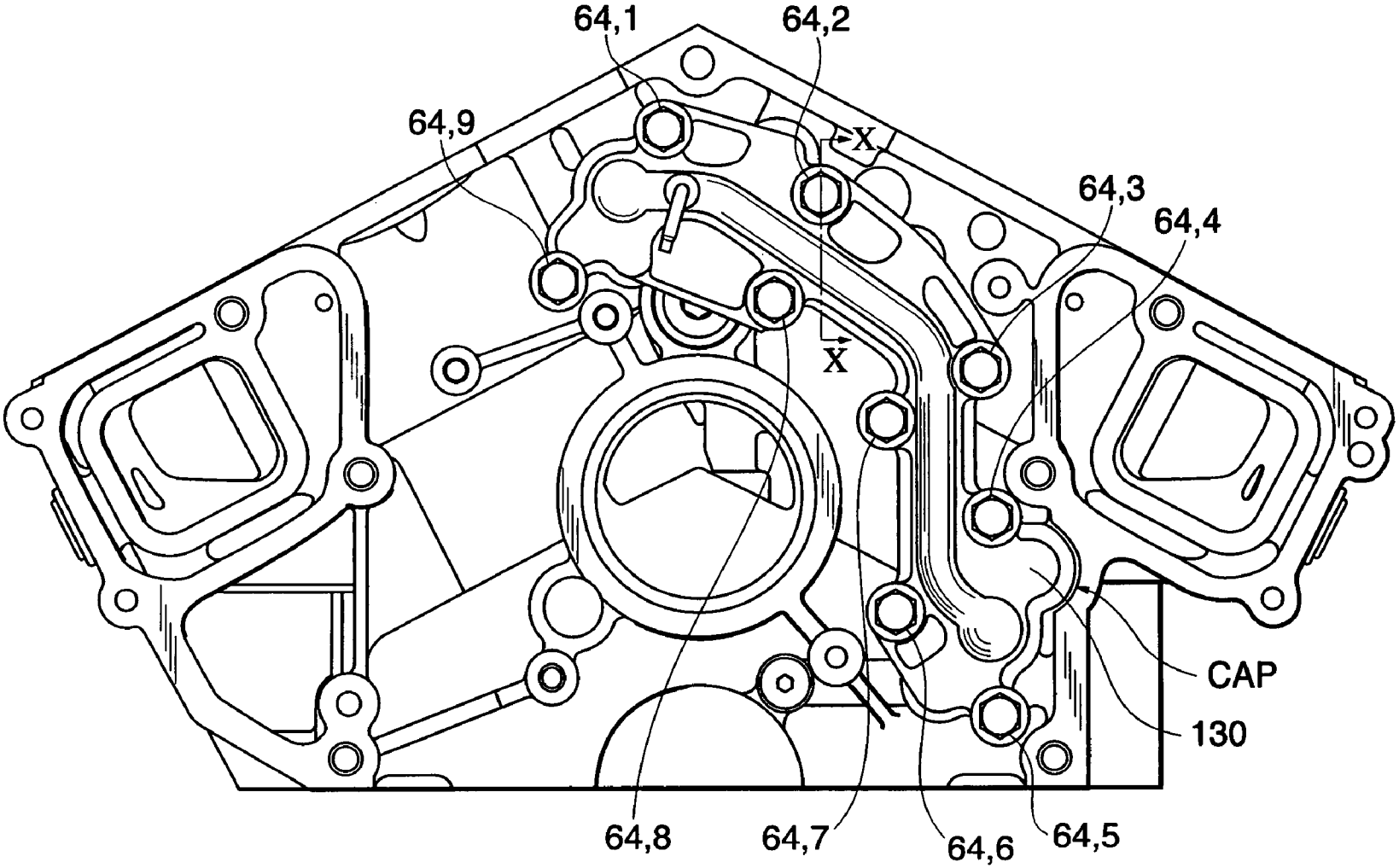
FIG. 7 is a bottom view of a cylinder block with a plate and a cover attached thereto.
Figure 8:
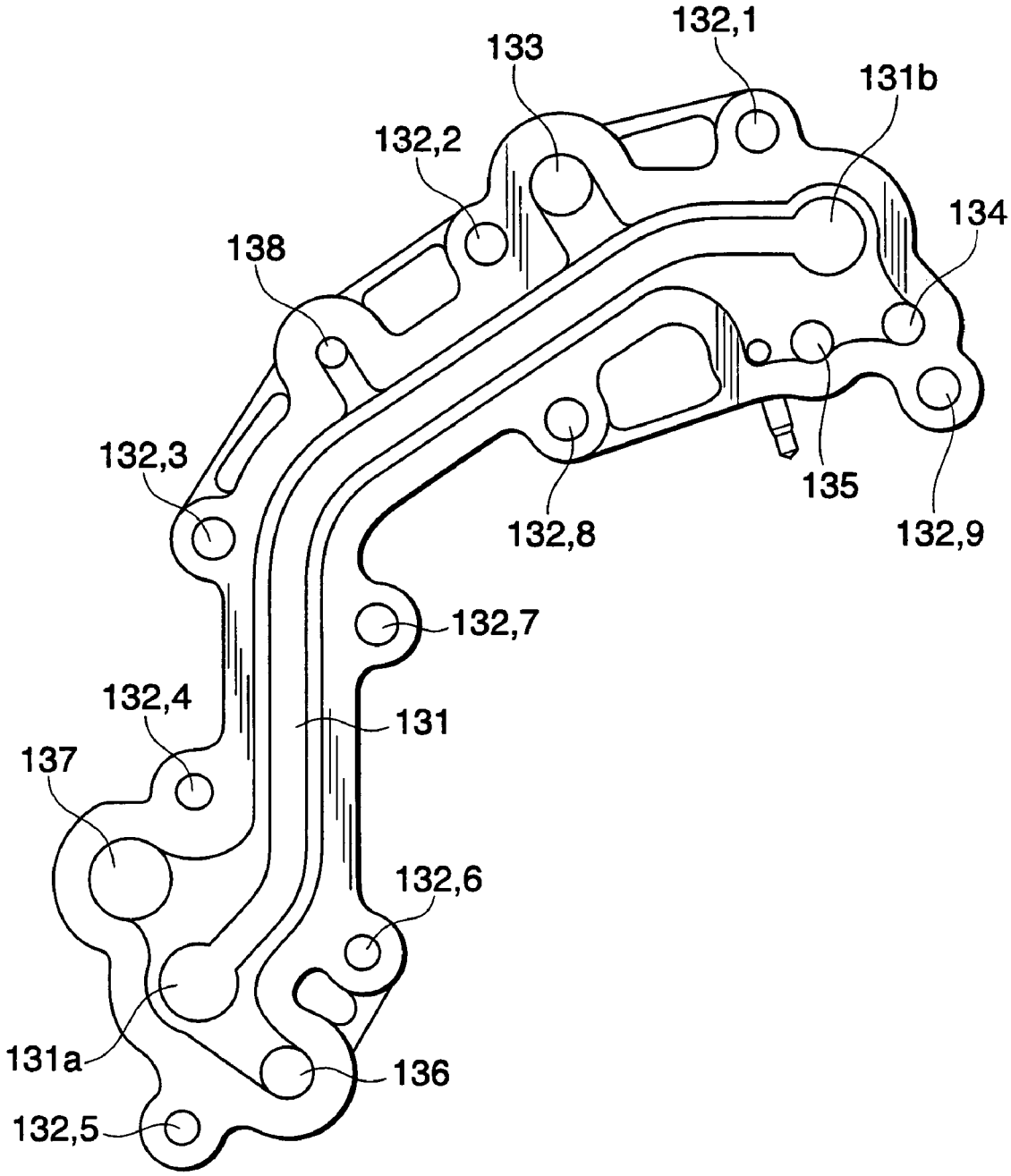
FIG. 8 is a rear view of the cover.
Figure 9:
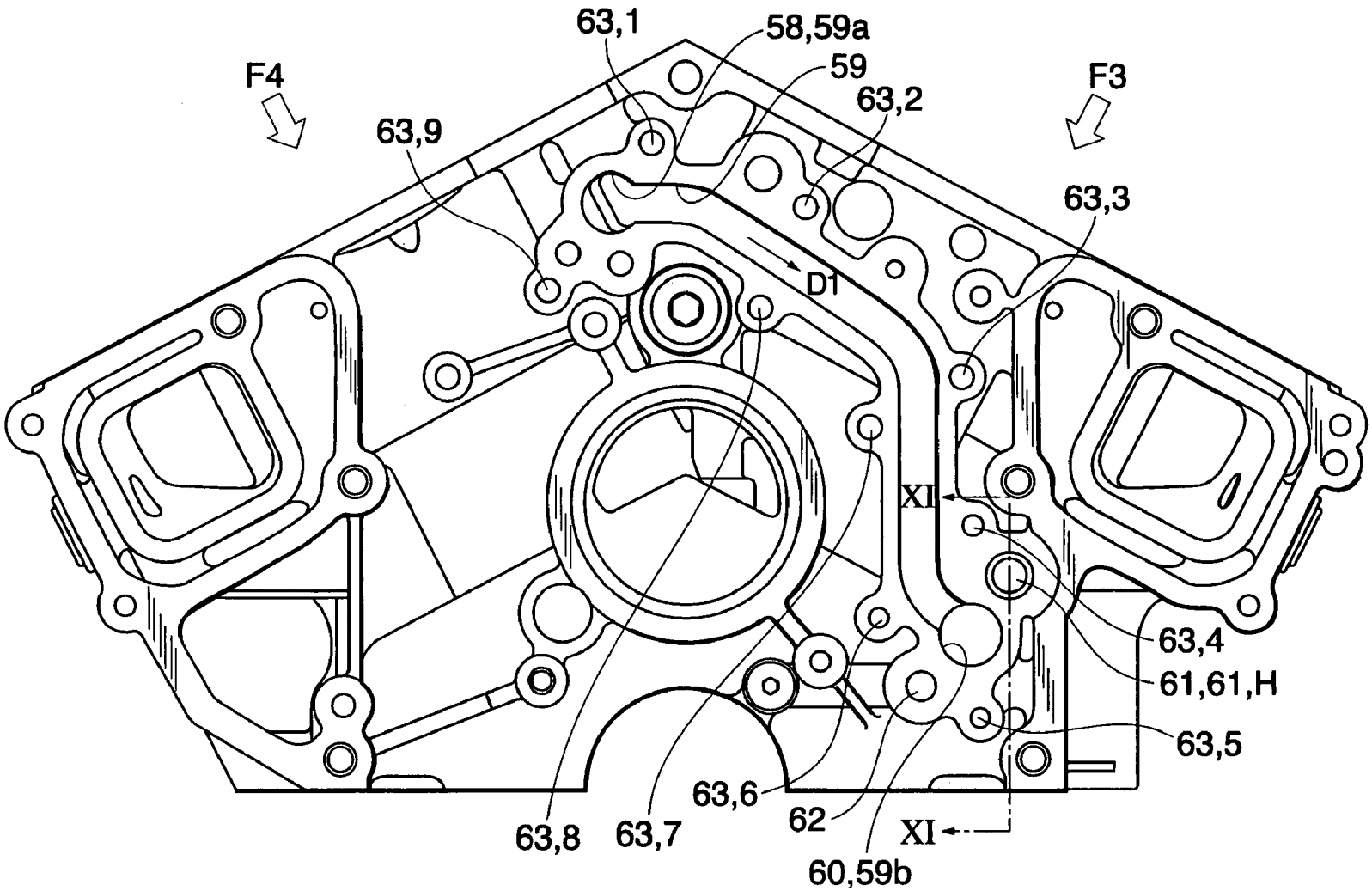
FIG. 9 is a bottom view of the cylinder block in a state before a lid assembly is attached thereto.
Figure 10:
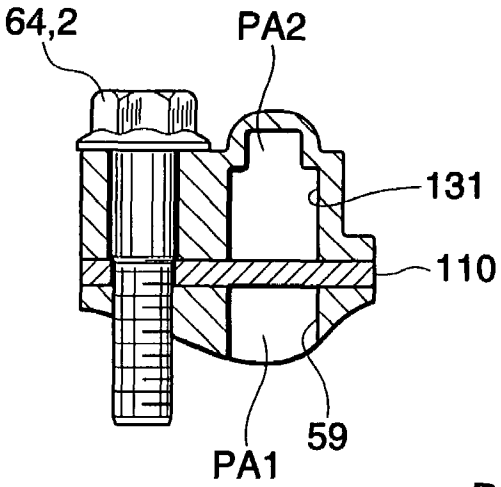
FIG. 10 is a fragmentary cross-sectional view taken on line X—X in FIG. 7.

FIG. 7 is a bottom view of the cylinder block 50 with the plate 110 and the cover 130 attached thereto. Hereafter, an assembly formed by the plate 110 and the cover 130 will be hereinafter referred to as "the lid assembly CAP". FIG. 8 is a rear view of the cover 130. FIG. 9 is a bottom view of the cylinder block 50 in a state before the lid assembly CAP is attached thereto. FIG. 10 is a fragmentary cross-sectional view taken on line X—X in FIG. 7.

As shown in FIG. 8, the cover 130 is a one-piece member formed e.g. of a metal, and has a recessed groove 131 formed in a rear surface thereof, i.e. a surface opposed to the plate 110 when the lid assembly CAP is formed. The recessed groove 131, which cooperates with the plate 110 to form a part of the oil return passage PA2, is gently curved to reduce fluid resistance generated during oil supply. The opposite ends of the recessed groove 131 will be hereinafter referred to as "the start end 131*a*" and "the terminal end 131*b*", respectively, in accordance with the direction of oil flow. Further, the cover 130 is formed therein with passage-associated recesses 133 to 138 respectively corresponding to oil passages, referred to hereinafter, and the passage-associated recesses 133 to 138 are continuous with the recessed groove 131. Furthermore, the cover 130 has bolt insertion holes 132(1) to 132(9) formed therethrough and arranged at respective suitable locations.

On the other hand, although not shown in detail, the plate 110 is formed by a plate member e.g. of a metal 3 and has substantially the same shape in plan view as the outer periphery of the cover 130. Further, the oil plate 110 has oil-passing holes formed at respective locations corresponding to the passage-associated recesses 133 to 138.

As shown in FIG. 9, in the bottom surface of the cylinder block 50, a recessed groove 59 is formed by casting at a location corresponding to a location where the lid assembly CAP is mounted. The recessed groove 59, which cooperates with the plate 110 to form a part of the oil supply passage PA1, has the same gently curved shape in plan view as the recessed groove 131 of the cover 130. This makes it possible not only to reduce fluid resistance generated in the oil supply passage PA1 during oil supply, but also to save an area or space occupied by the oil supply passage PA1 and the oil return passage PA2 in the bottom surface of the cylinder block 50. The opposite ends of the recessed groove 59 will be hereinafter referred to as "the start end 59*a*" and "the terminal end 59*b*", respectively, in accordance with the direction of oil flow (direction indicated by an arrow D1 in FIG. 9.

The cylinder block 50 is formed therein with bolt mounting holes 63(1) to 63(9) in association with the bolt insertion holes 132(1) to 132(9), respectively. The cover 130 is disposed on the bottom surface of the cylinder block 50 via the plate 110 as shown in FIG. 10, and fastened and fixed to the cylinder block 50 together with the plate 110 by bolts 64(1) to 64(9) as shown in FIGS. 7 and 10. Thus, the recessed groove 59 is sealed by the plate 110 except the start end 59*a* and the terminal end 59*b*, whereby the oil supply passage PA1 is formed. At the same time, the recessed groove 131 is sealed by the plate 110 except the start end 131*a* and the terminal end 131*b*, whereby the oil return passage PA2 is formed (see FIGS. 6 and 10). Since the oil supply passage PA1 and the oil return passage PA2 are formed by fastening the cover 130 and the plate 110 together to the cylinder block 50 as described above, it is possible to make effective use of space.

The start end 59*a* of the recessed groove 59 also corresponds to the opening of the oil hole 58 (see FIG. 6) in the bottom surface of the cylinder block 50, and oil supplied under pressure from the oil pump 31 flows from the oil hole 58 (start end 59*a*) into the oil supply passage PA1 as described hereinbefore. Further, in the cylinder block 50, an oil passage 60 extends vertically at a location corresponding to the terminal end 59*b* of the recessed groove 59 (see FIG. 9), so that oil having passed through the oil supply passage PA1 flows into the oil passage 60 via the terminal end 59*b*.

Further, as shown in FIG. 9, a main oil gallery 61 is formed vertically in a starboard-side side part of the cylinder block 50. The present embodiment is thus characterized in that the main oil gallery 61 is formed not in the central part of the cylinder block 50 in the transverse direction of the same, but at a location outward of the cylinder bore 51.

Figure 11:
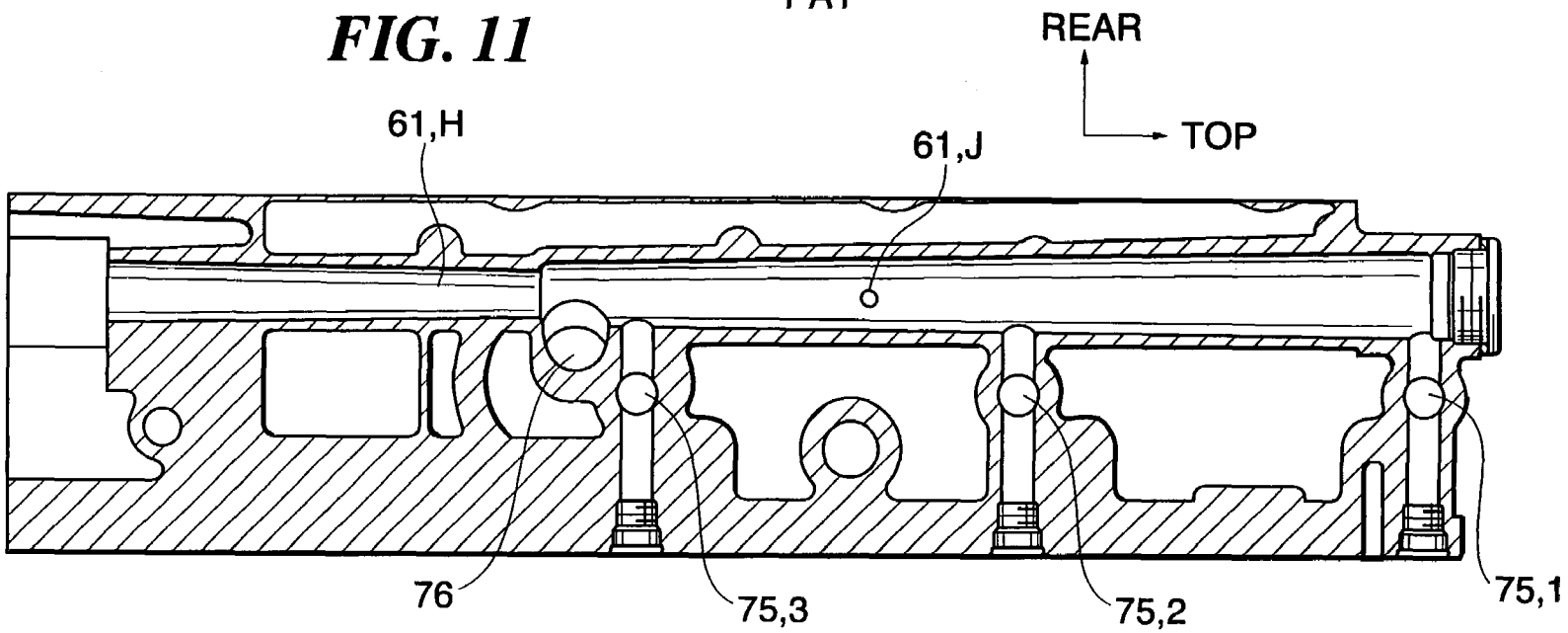
FIG. 11 is a cross-sectional view taken on line XI—XI in FIG. 9.
Figure 12:
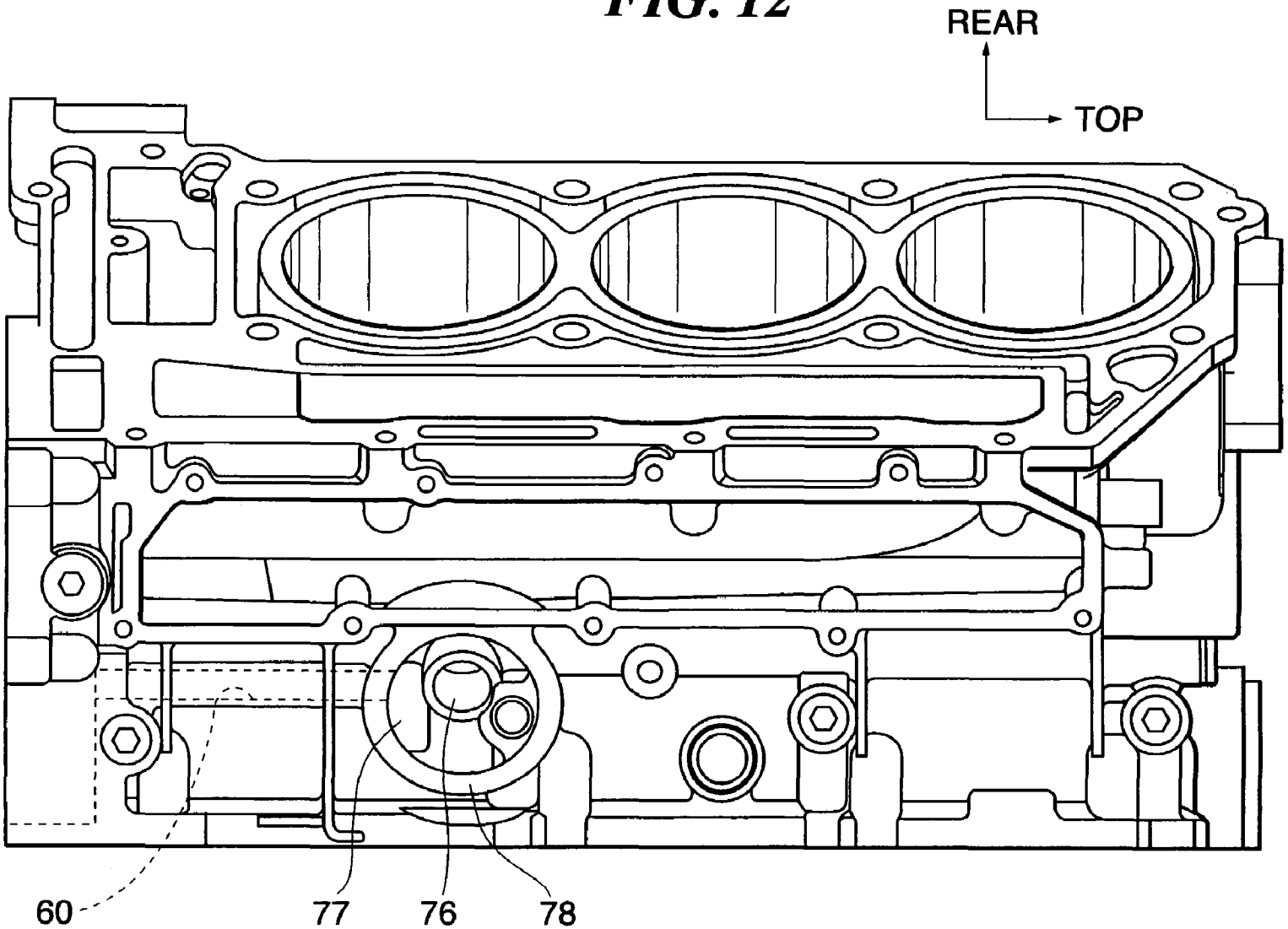
FIG. 12 is a right side view of the cylinder block.
Figure 13:
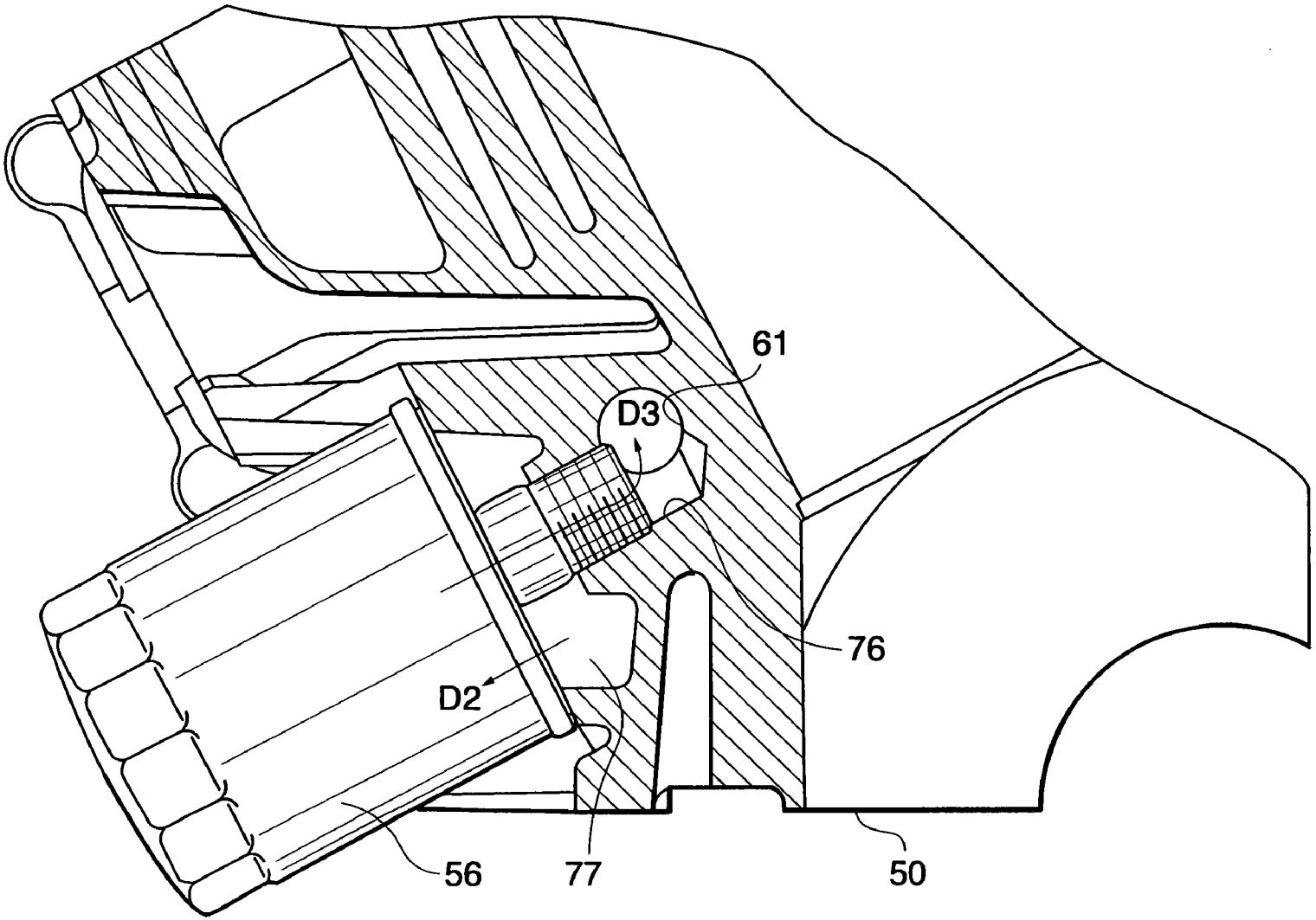
FIG. 13 is a view of an oil filter attached to the cylinder block, and component parts in the vicinity of the oil filter.

FIG. 11 is a cross-sectional view taken on line XI—XI in FIG. 9. FIG. 12 is a right-side view of the cylinder block 50. In FIGS. 11 and 12, the top side corresponds to the rear side of the cylinder block 50. FIG. 13 is a view, partly in cross section, showing an oil filter 56 attached to the cylinder block 50 and component parts in the vicinity of the oil filter 56.

As shown in FIG. 11, the main oil gallery 61 is formed by casting and extends vertically. An upper part 61(J) (right-side part as viewed in FIG. 11)) of the main oil gallery 61 is slightly larger in diameter than a lower part 61(H) thereof. As shown in FIGS. 12 and 13, in the lower right-side part of the cylinder block 50, there is formed a filter mounting part 78 in which the filter 56 is mounted. The filter mounting part 78 is formed therein with an oil chamber 77 as a dirty side and an oil chamber 76 as a clean side. The oil passage 60 is in communication with the oil chamber 77. As shown in FIGS. 12 and 13, the main oil gallery 61 is in communication with the oil chamber 76 in proximity to the oil filter 56, whereby the oil filter 56 is held in a state almost directly connected to the main oil gallery 61.

Oil supplied through the oil passage 60 flows into the oil filter 56 (in a direction D2) via the oil chamber 77 (dirty side) as shown in FIG. 13 to be filtered, and then supplied from the oil chamber 76 (clean side) to the main oil gallery 61 (in a direction D3), whereafter the oil is divided into two flows, i.e. a flow through the upper part 61(J) of the main oil gallery 61 and a flow through the lower part 61(H) of the same, thereby being supplied to predetermined locations.

As shown in FIG. 11, oil passages 75(1) to 75(3) for lubrication of crank journals are continuous with the upper part 61(J) of the main oil gallery 61. Lubricating oil is supplied to upper three of four crank journals of the crankshaft 3 through the respective oil passages 75(1) to 75(3). To the remaining or lowermost crank journal, lubricating oil which has once flowed from the lower part 61(H) of the main oil gallery 61 through the oil return passage PA2, is supplied via an oil passage 62 (see FIG. 9), referred to hereinbelow.

Figure 14:
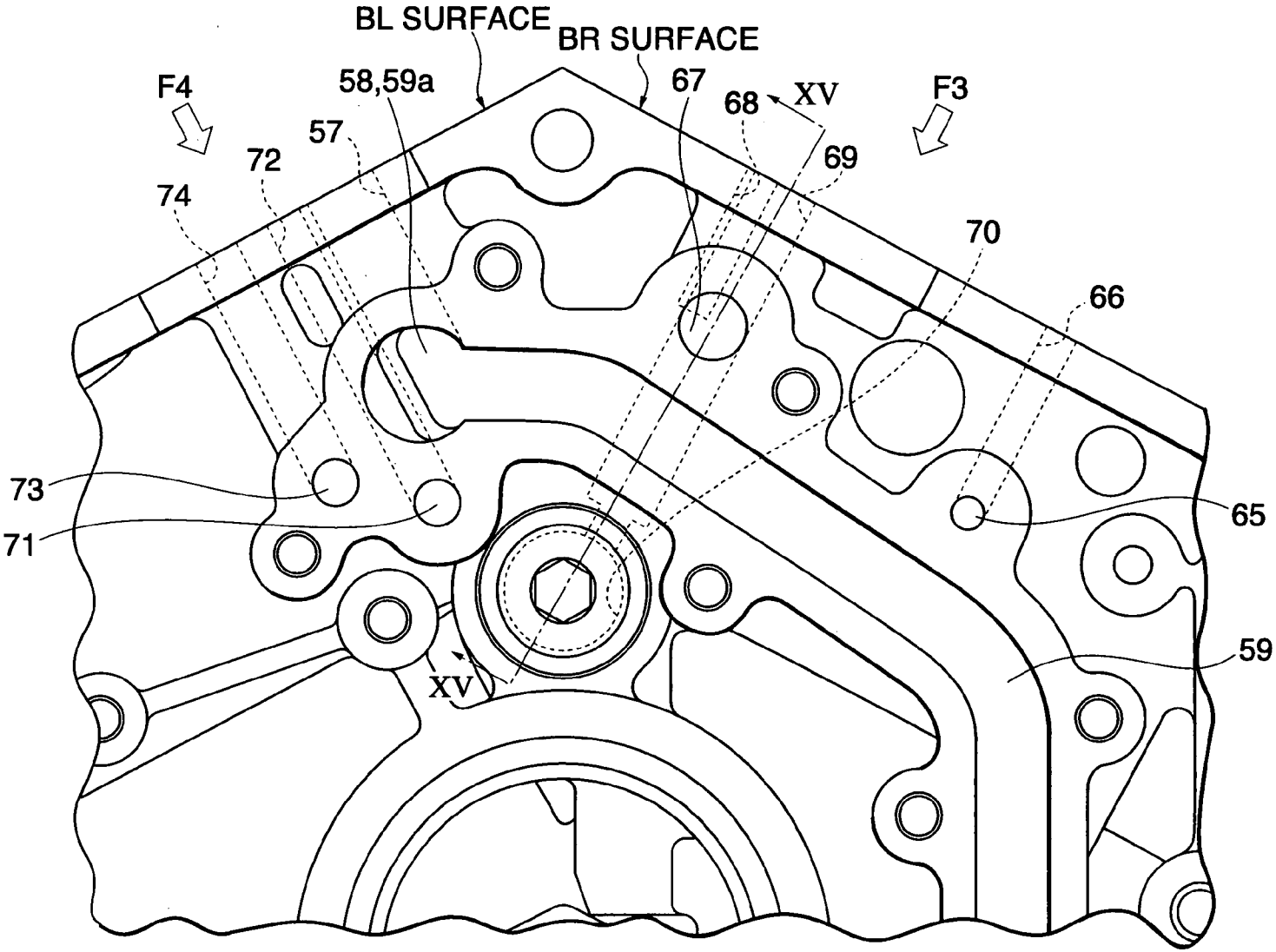
FIG. 14 is a fragmentary bottom view of the cylinder block.

FIG. 14 is a fragmentary bottom view of the cylinder block 50. FIG. 14 shows a part of the cylinder block 50 in FIG. 9 on an enlarged scale.

In the bottom surface of the cylinder block 50, there are formed various oil passages associated with the respective passage-associated recesses 133 to 138. More specifically, there are formed oil passages 65, 67, 71, and 73 as oil-distributing passages in addition to the main oil gallery 61 and the oil passage 62 (see FIG. 9). The passage-associated recesses 137 and 136 formed in the cover 130 are associated with the main oil gallery 61 and the oil passage 62, respectively. The passage-associated recesses 138, 133, 135, and 134 formed in the cover 130 are associated with the oil passages 65, 67, 71, and 73, respectively.

Figure 15:
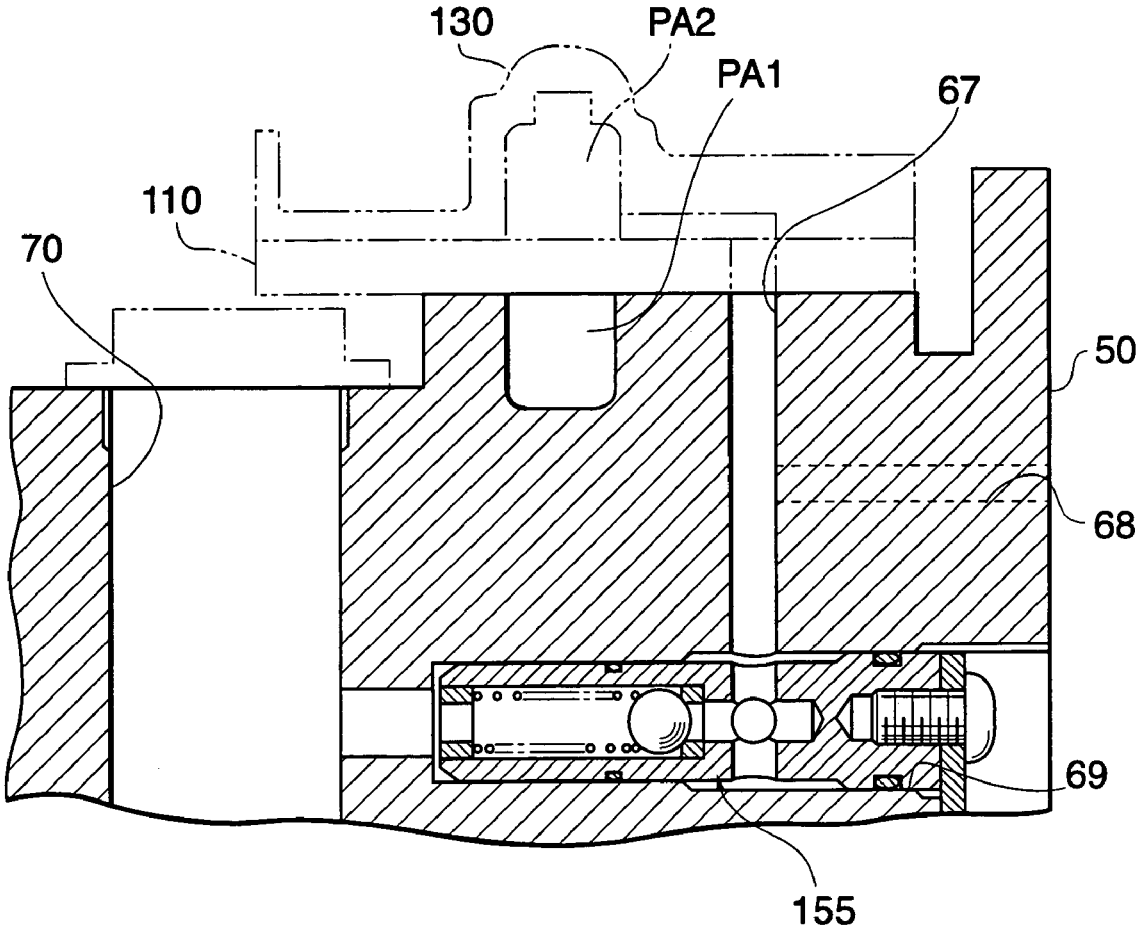
FIG. 15 is a fragmentary cross-sectional view taken on line XV—XV in FIG. 14.

FIG. 15 is a fragmentary cross-sectional view taken on line XV—XV in FIG. 14.

Within the cylinder block 50, there is formed a relief valve-fitting hole 69 in which a relief valve 155 is fitted. The relief valve-fitting hole 69 is in communication with the piston-cooling gallery 70 and the oil passage 67. The relief valve 155 allows oil to pass therethrough toward the piston-cooling gallery 70 when the pressure of oil supplied from the oil passage 67 is equal to or higher than a predetermined value (e.g. 3 kg/cm$^2$), whereas when the oil pressure is lower than the predetermined value, the relief valve 155 blocks the flow of oil, thus causing component parts of the engine to be preferentially lubricated.

Figure 16A:
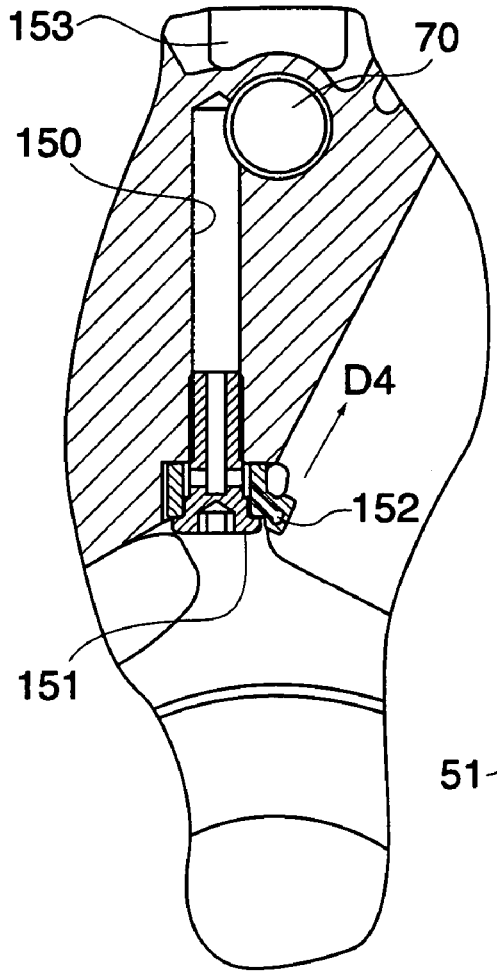
FIG. 16A is a fragmentary cross-sectional view of the cylinder block.
Figure 16B:
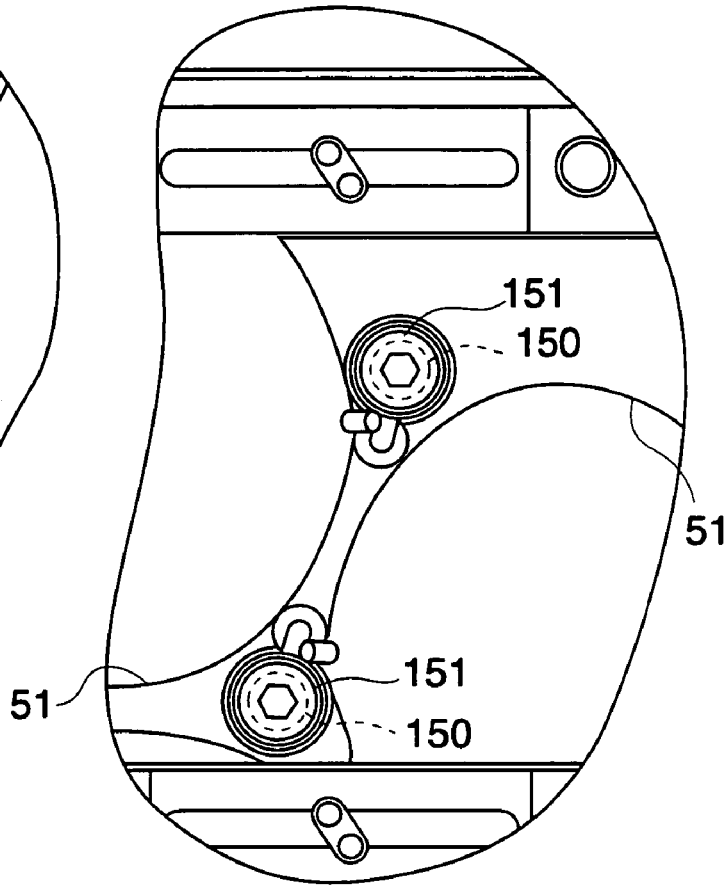
FIG. 16B is a fragmentary view showing the appearance of cylinder bores of the cylinder block and component parts in the vicinity of the cylinder bores, as viewed from a connecting rod side.

FIG. 16A is a fragmentary cross-sectional view of the cylinder block, showing the piston-cooling gallery 70 and one of the piston jet passages 150 as viewed from above, similarly to FIG. 3. FIG. 16B is a fragmentary view showing the appearance of the cylinder bores 51 and component parts in the vicinity thereof, as viewed from the connecting rod 34 side.

The cylinder block 50 is formed therein with six piston jet passages 150 in association with the six cylinder bores 51, respectively. The piston jet passages 150 are in a staggered arrangement as shown in FIG. 16B, and connected to the piston-cooling gallery 70. Each piston jet passage 150 is closed by a bolt 151 with a hole, and the bolt 151 is formed therein with a nozzle 152 in communication with the piston jet passage 150. The nozzle 152 is directed toward the piston 53 (see FIG. 3: not shown in FIG. 6) within the associated cylinder bore 51 (i.e. in a direction indicated by an arrow D4).

As described hereinbefore, the piston-cooling gallery cooling passage 153 is disposed in proximity to the piston-cooling gallery 70 as shown in FIG. 16A, so that oil passing through the piston-cooling gallery 70 is cooled efficiently by coolant passing through the piston-cooling gallery cooling passage 153. The cooled oil is supplied to each of the piston jet passages 150 from the piston-cooling gallery 70 and jetted as cooling oil from the nozzle 152 to cool the associated piston 53.

As shown in FIGS. 14 and 15, an oil passage (second passage) 68 is provided in communication with the oil passage 67, and opens in a BR surface (starboard-side surface opposed to the cylinder head) of the cylinder block 50. Further, as shown in FIG. 14, there are formed an oil passage (first passage) 66 opening in the BR surface and in communication with the oil passage 65, and an oil passage (first passage) 72 and an oil passage (second passage) 74 both opening in a BL surface (port-side surface opposed to the cylinder head) and in communication with the respective oil passages 71 and 73. As described above, the oil passages 66, 68, 72, and 74 are formed as separate passages.

Next, a description will be given of paths for supplying lubricating oil to the cylinder heads 80, the variable valve timing devices 100, and the oil control valves 101.

Figure 17:
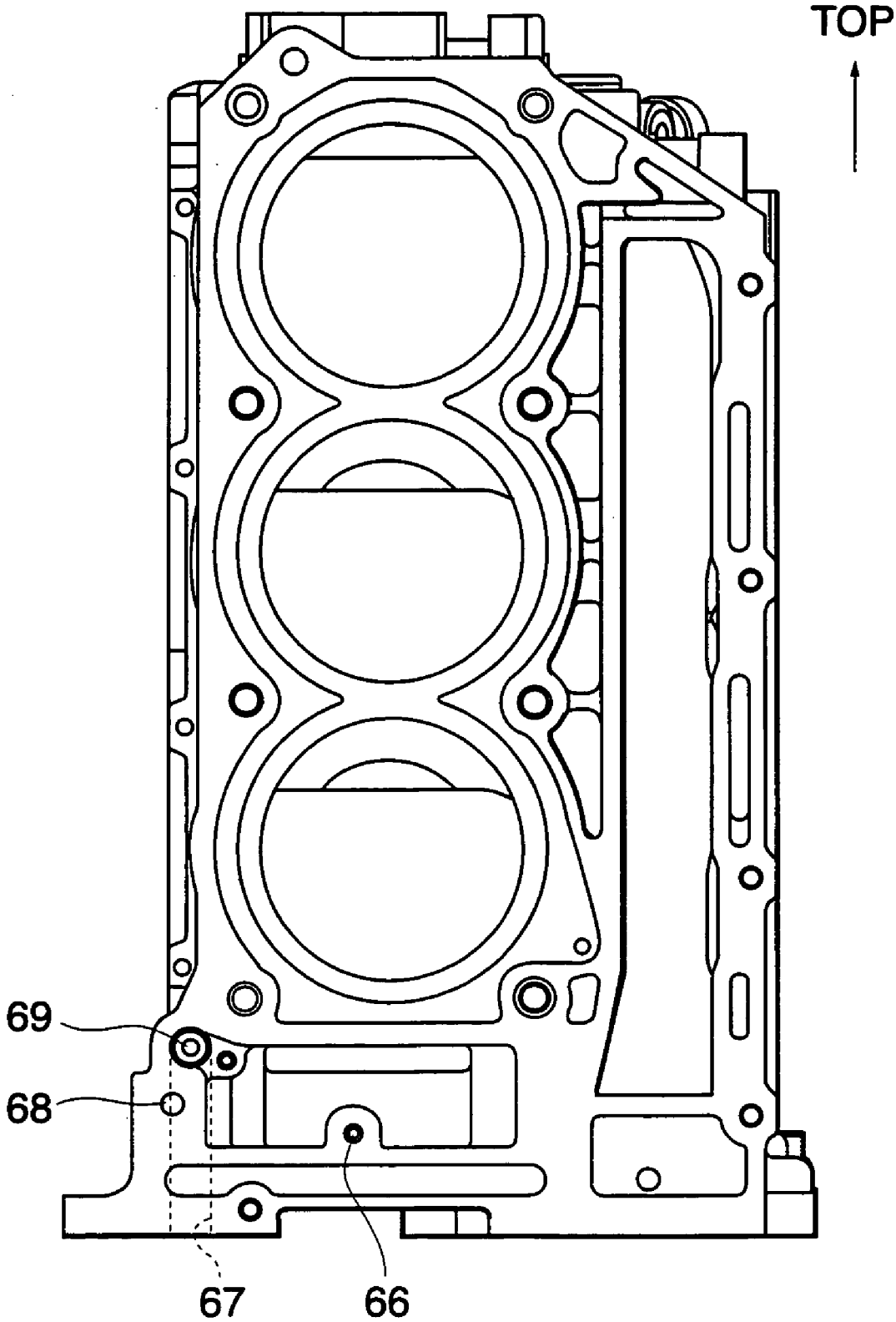
FIG. 17 is a view taken from an arrow F3 in FIG. 14 (i.e. a plan view of a surface of the cylinder block opposed to a starboard-side cylinder head)
Figure 18:
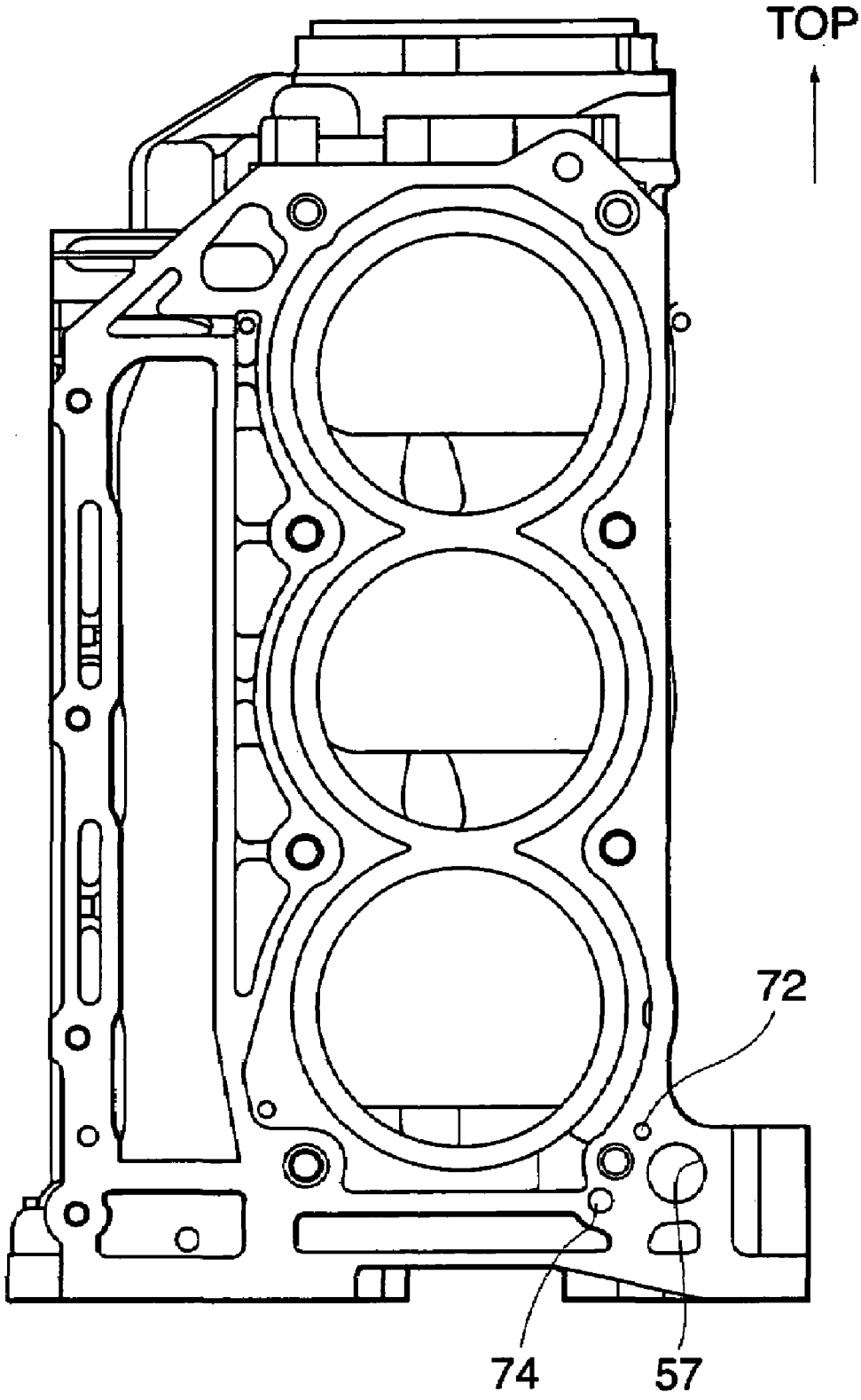
FIG. 18 is a view taken from an arrow F4 in FIG. 14 (i.e. a plan view of a surface of the cylinder block opposed to a port-side cylinder head)

FIG. 17 is a view taken from an arrow F3 in FIG. 14, i.e. a plan view of the BR surface of the cylinder block 50. FIG. 18 is a view taken from an arrow F4 in FIG. 14, i.e. a plan view of the BL surface of the cylinder block 50. In FIGS. 17 and 18, the top side thereof corresponds to the top side of the cylinder block 50.

Figure 19:
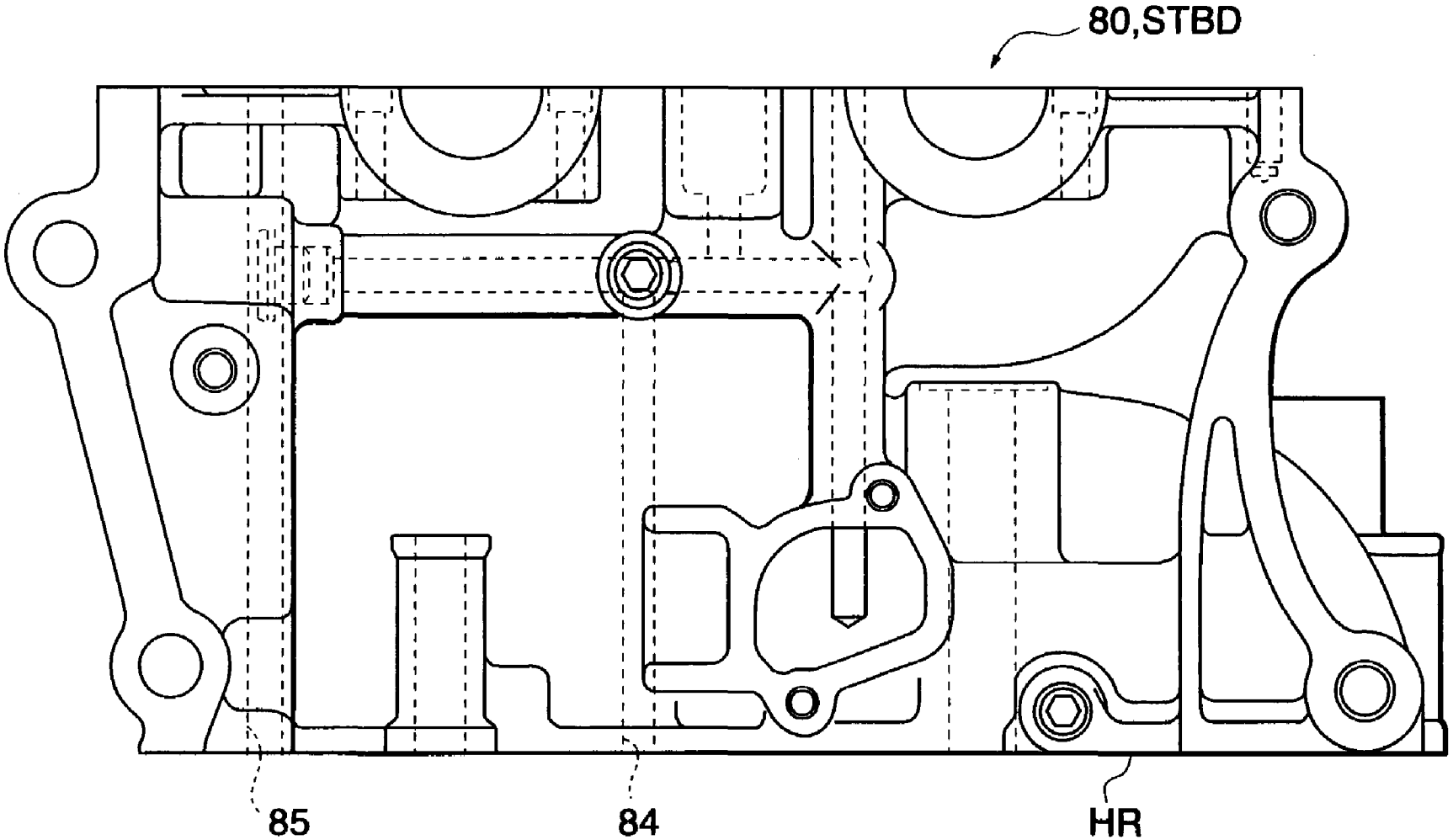
FIG. 19 is a bottom view of the starboard-side cylinder head (STBD)
Figure 20:
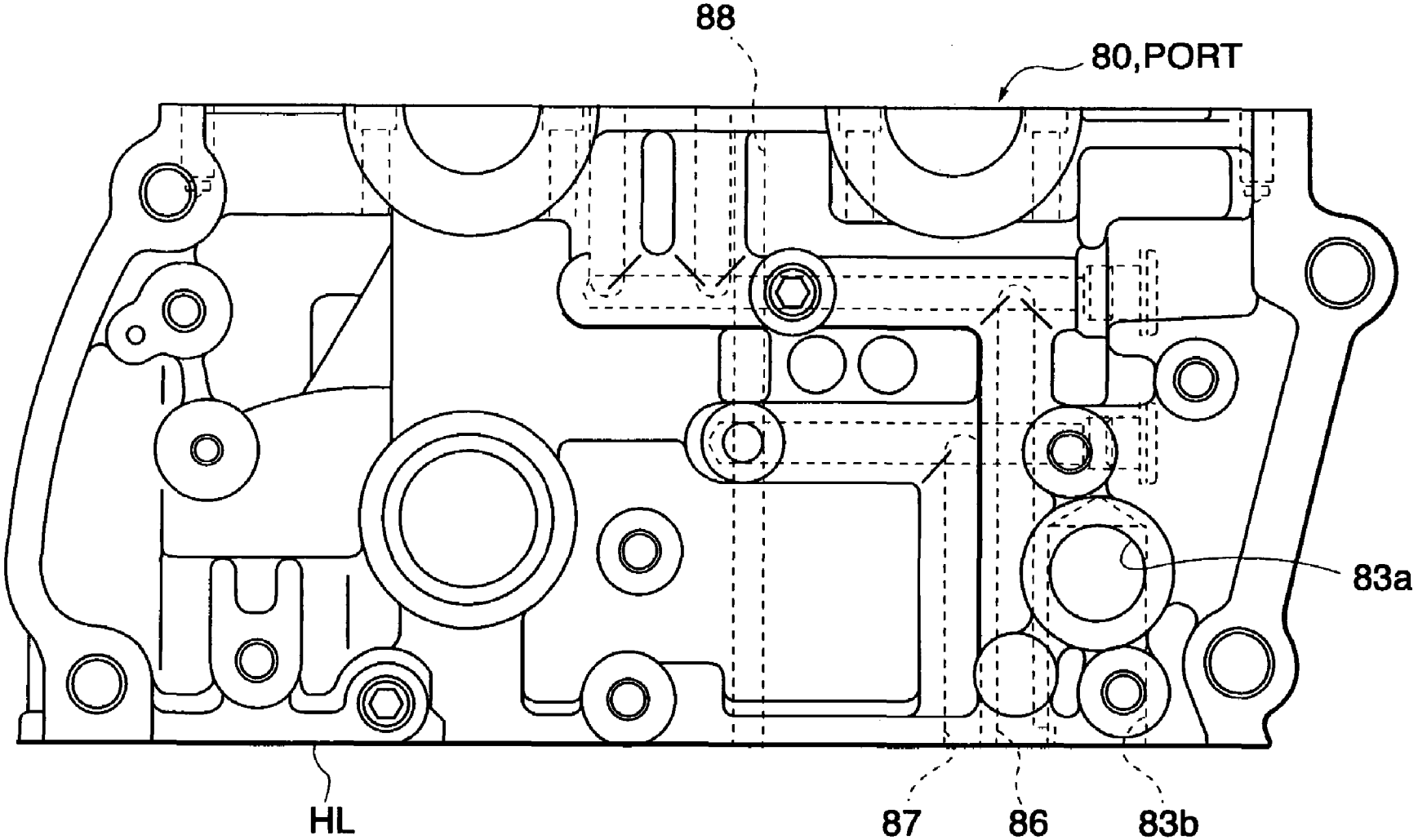
FIG. 20 is a bottom view of the port-side cylinder head (PORT).

FIG. 19 is a bottom view of the starboard-side cylinder head 80 (STBD), in which HR denotes a block-opposed surface opposed to the BR surface of the cylinder block 50. FIG. 20 is a bottom view of the port-side cylinder head 80 (PORT), in which HL denotes a block-opposed surface opposed to the BL surface of the cylinder block 50.

As shown in FIG. 19, in the starboard-side cylinder head 80 (STBD), an oil passage (head-lubricating oil hole) 84 and an oil passage (mechanism-driving oil hole) 85 are formed separately from each other as separate passages. The oil passage 84 is for lubricating the inside of the cylinder head 80 (STBD), and branches out inside the cylinder head 80. The oil passage 85 is for supplying driving oil to the variable valve timing devices 100 and the oil control valves 101 (which will be hereinafter collectively referred to as "the variable valve timing system (variable valve timing mechanism)"). The oil passage 85 does not intersect the oil passage 84, and opens in a surface of the cylinder head 80 opposite to the block-opposed surface HR.

The block-opposed surface HR of the starboard-side cylinder head 80 (STBD) and the BR surface of the cylinder block 50 are joined to each other such that the oil passage 84 is aligned with the oil passage 66 appearing in FIG. 14, and the oil passage 85 is aligned with the oil passage 68. Accordingly, oil from the oil return passage PA2 flows as lubricating oil through the oil passage 65 (see FIG. 14) and the oil passage 66 into the oil passage 84 to lubricate the inside of the cylinder head 80 (STBD). On the other hand, oil from the oil return passage PA2 flows through the oil passage 67 and the oil passage 68 into the oil passage 85 (see FIG. 15 as well) to be supplied as driving oil to the starboard-side variable valve timing system. This reduces influence of pressure variation in the path for lubrication of the cylinder head upon the path for supplying driving oil to the variable valve timing system. Further, as described hereinabove, part of the oil flowing into the oil passage 67 is supplied to the piston-cooling gallery 70 via the relief valve 155.

As shown in FIG. 20, in the cylinder head 80 (PORT), an oil passage (head-lubricating oil hole) 86 and an oil passage (mechanism-driving oil hole) 87 are formed as separate passages. The oil passage 86 is for lubricating the inside of the cylinder head 80 (PORT), and branches out inside the cylinder head 80. The oil passage 87 is for supplying driving oil to a port-side variable valve timing system. The oil passage 87 does not intersect the oil passage 86, and is continuous with an oil passage 88 opening in a surface of the cylinder head 80 opposite to the block-opposed surface HL.

The block-opposed surface HL of the cylinder head 80 (PORT) and the BL surface of the cylinder block 50 are joined to each other such that an open end of the oil passage 86 in the form of a somewhat elongated hole is aligned with the oil passage 72 appearing in FIG. 14, and the oil passage 87 is aligned with the oil passage 74. The outlet port 83*b* of the oil passage 83 of the cylinder head 80 (PORT) is aligned with the oil passage 57 of the cylinder block 50 (see FIG. 6 as well).

Accordingly, oil from the oil return passage PA2 flows as lubricating oil through the oil passage 71 and the oil passage 72 into the oil passage 86 to lubricate the inside of the cylinder head 80 (PORT). On the other hand, oil from the oil return passage PA2 flows through the oil passage 73 and the oil passage 74 into the oil passage 87 to be supplied as driving oil to the port-side variable valve timing system.

In the construction described above, oil flows through the following paths:

Oil stored in the oil pan 5 is pumped up by the oil pump 31 through the oil strainer 32 (see FIG. 2) and discharged from the oil discharge port 31*b* (see FIG. 4). Then, the oil flows through the oil passage 83 of the port-side cylinder head 80 (PORT) into the oil passage 57 of the cylinder block 50 (see FIG. 6). Further, the oil from the oil passage 57 flows through the oil passage 58 into the oil supply passage PA1.

Then, the oil in the oil supply passage PA1 flows in the direction indicated by the arrow D1 shown in FIG. 9 and reaches the oil filter 56 via the oil passage 60. The oil filtered by the oil filter 56 enters the main oil gallery 61 (see FIGS. 11 to 13). Oil having flowed into the upper part 61(J) of the main oil gallery 61 is supplied as lubricating oil to the three upper crank journals of the crankshaft 3 through the oil passages 75(1) to 75(3). The oil supplied to the upper crank journals of the crankshaft 3 drops by gravity to be collected in the oil pan 5. On the other hand, oil having flowed into the lower part (61H) of the main oil gallery 61 flows into the oil return passage PA2.

The oil having flowed into the oil return passage PA2 is supplied as lubricating oil to the remaining or lowermost crank journal through the oil passage 62. Part of the oil having entered the oil return passage PA2 flows in the opposite direction to the direction D1 and flows through the oil passage 67 into the piston-cooling gallery 70 via the relief valve 155 (see FIGS. 14 and 15). The oil is cooled by the coolant within the piston-cooling gallery cooling passage 153, and then passes through the piston jet passage 150 to be jetted from the nozzle 152 toward the piston 53. Thereafter, the oil drops by gravity to be collected in the oil pan 5.

Further, as described hereinabove with reference to FIGS. 14 and 17 to 20, the oil flowing through the oil return passage PA2 partly flows to the cylinder head 80 (STBD) via a path of the oil passage 65→the oil passage 66→the oil passage 84 and to the cylinder head 80 (PORT) via the path of the oil passage 71→the oil passage 72→the oil passage 86, as lubricating oil, to lubricate the inside of the cylinder heads 80, and then drops by gravity to be collected in the oil pan 5. Furthermore, the oil flowing through the oil return passage PA2 partly flows through the path of the oil passage 67→the oil passage 68→the oil passage 85 and the path of the oil passage 73→the oil passage 74→the oil passage 87, so as to be supplied as driving oil to the respective valve timing systems.

According to the present embodiment, the oil supply passage PA1 to the oil filter 56 and the oil return passage PA2 from the same are formed in the lower part of the cylinder block 50 in a fashion being isolated from each other by the plate 110 as a partition, so that compared with the conventional case where the supply passage and the return passage are formed within the cylinder block 50, it is possible to lay out the two passages PA1 and PA2 while easily avoiding interference with a water jacket and the like, thereby enhancing the degree of freedom of layout of the oil passages. Further, since the two passages PA1 and PA2 are formed such they extend along the same curve in plan view, space under the bottom surface of the cylinder block 50 can be saved. As a result, it is possible to prevent the cylinder block 50 from having an excess thickness, which enables effective use of space, thereby contributing to reduction of the size of the outboard motor. Furthermore, the oil supply passage PA1 is formed by covering the recessed groove 59, which is formed by casting in the bottom surface of the cylinder block 50, with the plate 110, and the oil return passage PA2 is formed by joining the plate 110 and the cover 130 to each other to form the lid assembly CAP, wherein the recessed groove 131 formed integrally with the cover 130 is sealed by the plate 110. This provides not only the advantage of facilitating the formation of the two passages PA1, PA2 but also the advantage of decreasing the number of portions of the oil path which require machining to form cast holes in communication with each other, i.e. the number of portions which are bent at right angles, which reduces fluid resistance as well as the occurrence of contamination due to machining burrs, thereby realizing smooth oil supply as a whole.

Further, according to the present embodiment, the oil passages (66 and 72) for supplying oil delivered under pressure from the oil pump 31, as lubricating oil, to the cylinder heads 80 and the oil passages (68 and 74) for supplying the oil, as driving oil, to the variable valve timing system are formed, as separate passages, in the cylinder block 50 not in the cylinder heads 80. As a result, the path for lubricating the cylinder heads and the path for supplying driving oil to the variable valve timing system are separated in the cylinder block 50 at a location before oil flows into the cylinder heads 80, and since the inside of the cylinder block 50 allows oil passages having a large cross-sectional area to be formed therein with ease, interference between the two paths can be suppressed, which enables stable oil supply through the paths. Therefore, it is possible to reduce influence of pressure variation in the oil path for lubricating the cylinder heads upon the path for supplying driving oil to the variable valve timing system without additionally providing an oil pump for the variable valve timing system, thereby stabilizing the operation of the variable valve timing system. Thus, it is possible to prevent the construction from being complicated, and suppress increase in manufacturing costs.

Furthermore, according to the present embodiment, since the V-type engine having a vertically disposed crankshaft has the main oil gallery 61 formed in the side part of the cylinder block 50 (i.e. the side part of the engine 2), it is possible to secure a sufficient cross-sectional area for the main oil gallery 61 despite the small bank angle of 55 degrees. In short, it is possible to secure a sufficient cross-sectional area for the main oil gallery 61 while preventing an increase in the width of the engine, which stabilizes supply of lubricating oil to the crank journals etc.

Also, according to the present embodiment, since the piston-cooling gallery 70 is formed substantially in the central part of the engine 2 in the transverse direction of the same and as a separate passage from the main oil gallery 61, it is possible to prevent the main oil gallery 61 from being influenced e.g. by a drop in oil pressure in the path for cooling the pistons, as is distinct from the case where the piston-cooling gallery 70 is in direct communication with the main oil gallery 61. As a result, supply of lubricating oil to the crank journals is stabilized. Moreover, since the piston-cooling gallery 70 belongs to a path different from a path to which the main oil gallery 61 belongs, it is possible to cool the piston-cooling gallery 70 sufficiently without fear of dilution of oil by unburned fuel, and therefore it is possible to cool only the piston-cooling gallery 70 independently and efficiently by the piston-cooling gallery cooling passage formed at a location close thereto, thereby improving the efficiency of cooling the pistons. This construction in which the piston-cooling gallery 70 alone can be cooled independently is particularly advantageous because it is unfavorable to excessively cool oil for use in lubricating the inside of the engine.

Further, although in the conventional construction in which oil passages for cooling pistons extend from a main oil gallery, it is necessary to provide a relief valve in each piston jet passage, in the present embodiment, it is only necessary to provide a single relief valve in the relief valve-fitting hole 69 as the inlet port of the piston-cooling gallery 70, which reduces the number of component parts, and contributes to the simplification of the structure of the oil path.

Furthermore, since the oil filter 56 is disposed in the side part of the cylinder block 50 at a location close to the main oil gallery 61 in a fashion directly connected thereto, it is no longer necessary to provide a long passage for connecting between the oil filter 56 and the main oil gallery 61, which simplifies the structure of the oil path.

Although in the present embodiment, the main oil gallery 61 is formed in the starboard-side side part of the cylinder block 50, this is not limitative, but it may be formed in the port-side side part or in both of the two side parts.

Although in the present embodiment, the "lid assembly CAP" is formed by the plate 110 and the cover 130, it may be formed as a one-piece structure having the oil return passage PA2 formed therein.

Although in the present embodiment, a part of the oil supply passage PA1 is formed by the recessed groove 59 formed in the surface of the cylinder block 50 by casting, this is not limitative, but the vertical positional relationship between the oil supply passage PA1 and the oil return passage PA2 may be reversed, for example. Alternatively, the oil supply passage PA1 and the oil return passage PA2 may be formed in parallel with each other by forming a groove corresponding to the recessed groove 59 in the surface of the cylinder block 50 in parallel with the recessed groove 59 by casting, and then covering the two grooves by the plate 110. Further, alternatively, a "lid assembly CAP" in which both the oil supply passage PA1 and the oil return passage PA2 are formed may be attached to the cylinder block 50.

What is claimed is:

1. A lubricating structure for an outboard motor, comprising:

a vertically installed V-type engine having a side part;

a main oil gallery formed in said side part of said engine, for allowing lubricating oil to pass therethrough; and an oil gallery formed substantially in a central part of said engine in a transverse direction of said engine, as a passage separate from said main oil gallery, for allowing oil for cooling pistons to pass therethrough.

2. A lubricating structure as claimed in claim 1, comprising an oil filter disposed in said side part of said engine at a location close to said main oil gallery in a fashion directly connected thereto, for filtering the lubricating oil.

3. A lubricating structure as claimed in claim 1, comprising a coolant passage formed in said engine at a location close to said oil gallery, for cooling said oil gallery.

4. A lubricating structure for an outboard motor, comprising:

a vertically installed V-type engine including a cylinder block having a bottom part and an oil filter;

an oil passage formed in said bottom part of said cylinder block; and a supply passage extending to said oil filter and a return passage extending from said oil filter, said supply passage and said return passage being formed by partitioning said oil passage.

5. A lubricating structure as claimed in claim 4, comprising a lid assembly, and wherein at least one of said supply passage and said return passage has a part thereof formed by casting and covered by said lid assembly to form a passage.

6. A lubricating structure as claimed in claim 4, comprising a lid assembly, and wherein one of said supply passage and said return passage has a part thereof formed by casting and covered by said lid assembly to form a passage, and the other of said supply passage and said return passage is formed in said lid assembly.

7. A lubricating structure as claimed in claim 4, comprising a plurality of distribution passages in communication with said return passage, for distributing oil to component parts of said engine.

8. A lubricating structure for an outboard motor, comprising:

a cylinder block;

a cylinder head having an oil passage formed therein;

a hydraulically driven variable valve timing mechanism;

an oil pump for supplying oil under pressure, the oil supplied under pressure from said oil pump being supplied as driving oil to said variable valve timing mechanism from said cylinder block through said oil passage formed in said cylinder head, and supplied as lubricating oil to said cylinder head; and at least one first passage and at least one second passage formed as passages separate from each other in said cylinder block, for guiding the oil supplied under pressure from said oil pump to said cylinder head;

wherein said cylinder block has at least one head-lubricating oil hole formed therein, for supplying the oil supplied through said first passage formed in said cylinder block to component parts within said cylinder head, as lubricating oil; and wherein said cylinder block has at least one mechanism-driving oil hole formed therein, as a passage separate from said head-lubricating oil hole, for supplying the oil supplied through said second passage formed in said cylinder block to said variable valve timing mechanism, as driving oil.

* * * * *